US005092116A

United States Patent [19]

Kawasaki et al.

[11] Patent Number: 5,092,116

[45] Date of Patent: Mar. 3, 1992

[54] BOBBIN TRANSFER APPARATUS FOR SPINNING MACHINES

[75] Inventors: Yoshio Kawasaki; Tatsutake Horibe, both of Fujieda, Japan

[73] Assignee: Nisshinbo Industries, Inc., Tokyo, Japan

[21] Appl. No.: 553,633

[22] Filed: Jul. 18, 1990

[30] Foreign Application Priority Data

Jul. 19, 1989 [JP] Japan ..... 1-184491

[51] Int. Cl.[5] ..... D01H 9/10

[52] U.S. Cl. ..... 57/281; 57/90; 57/268; 57/270; 198/465.1

[58] Field of Search ..... 198/465.1, 487.1, 803.1, 198/803.12; 57/90, 281, 268, 270

[56] References Cited

U.S. PATENT DOCUMENTS

| | | | |
|---|---|---|---|
| 2,951,577 | 9/1960 | Wilcoxen | 198/584 |
| 4,046,248 | 8/1977 | Goffredo et al. | 198/583 |
| 4,720,967 | 1/1988 | Guttler | 57/90 X |
| 4,776,468 | 10/1988 | Kiriake | 57/270 X |
| 4,781,287 | 11/1988 | Fukushima | 198/803.1 |
| 4,821,504 | 4/1989 | Shinkai et al. | 57/268 X |
| 4,897,992 | 2/1990 | Kogiso et al. | 198/487.1 X |

FOREIGN PATENT DOCUMENTS

| | | |
|---|---|---|
| 0314089 | 5/1989 | European Pat. Off. . |
| 0347855 | 12/1989 | European Pat. Off. . |
| 3630670 | 4/1987 | Fed. Rep. of Germany . |
| 60-52475 | 3/1985 | Japan . |
| 62-180881 | 8/1987 | Japan . |
| 62-180882 | 8/1987 | Japan . |
| 62-191304 | 8/1987 | Japan . |
| 63-152662 | 6/1988 | Japan . |

*Primary Examiner*—Daniel P. Stodola
*Assistant Examiner*—William Stryjewski
*Attorney, Agent, or Firm*—Young & Thompson

[57] ABSTRACT

Apparatus for transferring empty and full bobbins to and from a plurality of juxtaposed spinning machines makes use of peg trays each having a peg engageable with a bobbin. The apparatus includes stationary bobbin transfer devices arranged on both sides of each spinning machine, and full bobbin and empty bobbin transfer conveyers both supported by a ceiling to intersect with the longitudinal direction of each spinning machine, above end portion of the stationary bobbin transfer devices thereof. The apparatus further includes a movable bobbin transfer device with an endless belt and linear guide members cooperating with the belt for resiliently engaging with each peg tray. The movable bobbin transfer device is arranged so as to be movable along the conveyers to receive empty bobbins from the empty bobbin transfer conveyer and deliver full bobbins to the full bobbins transfer conveyers. The movable bobbin transfer device has a lower end portion pivotally connected on both sides with respective one ends of bobbin transfer bridges which are rotatable so that their free end portions can be coupled to the stationary bobbin transfer device of a selected spinning machine.

6 Claims, 24 Drawing Sheets

7
F
8
E
12
N
F
12
7
1
13
11
F
16
12
E
8
9
M
GE
2b
17
E
F
K
10
H
50
64
3
R
E
5
4
12
3
51
12
12
12
50
64
63
62

BOBBIN TRANSFER APPARATUS FOR SPINNING MACHINES

BACKGROUND OF THE INVENTION

1. Field of the Invention

The present invention relates to an apparatus for transferring bobbins for a plurality of spinning machines, such as ring spinning frames, ring twisting frames or the like, and more particularly to an apparatus which is capable of transferring doffed full bobbins from the spinning machines to a subsequent station, such as a winding station or the like, and feeding empty bobbins to the spinning machines.

2. Description of the Related Art

In general, a thread manufactured by a spinning machine, particularly a ring spinning frame, is subjected by a winder to a winding-back to form a package having a size and shape suitable for subsequent processings. In that case, from a viewpoint of saving labor and improving output, there have been several fine spinning winders proposed in which the spinning machine and the winder are directly coupled with a bobbin transfer path so that a tubular threads or full bobbins doffed by the spinning machine are fed to the winder while the empty bobbins which have been processed by the winder are transferred to the transfer path respectively.

For example, Japanese Patent Application Laidopen Publication No. 60-52,475 discloses one arrangement of fine spinning winders which, as illustrated in FIG. 23, includes a plurality of juxtaposed winders 81 and spinning machines 82 with a main closed loop transfer path 83 on their one side, such that the winders 81 and the spinning machine 82 are each interconnected to the main transfer path 83 via sorters 84, 85 and transfer paths 86*a*, 86*b*, 87*a*, 87*b*. In this case, the full bobbins doffed from each spinning machine 82 are transferred through the transfer path 87*b* and the main transfer path 83 so as to be fed to the winder 81 through the sorter 84 and the transfer path 86*a*. Furthermore, after the thread has been wound back by the winder 81, the empty bobbins are transferred through the transfer path 86*b* and the main transfer path 83 and are fed back to each spinning machine 82 through the sorter 85 and the transfer path 87*a*. However, such an arrangement is disadvantageous in that, since the bobbin transfer paths are disposed on the floor surface, there have been substantial inconveniences or difficulties for operators to find a path for walking through or getting access to machineries, or for automatic vehicles to find a running path therethrough.

Another type of arrangement is disclosed in Japanese Patent Application Laid-open Publication No. 62-180,881 which, as illustrated in FIG. 24, includes a full bobbin transfer line 88 arranged above one end of the spinning machine 82 for transferring doffed full bobbins F to the winder station, and an empty bobbin transfer line 89 for transferring empty bobbins E to the fine spinning station after the winding process. These bobbin transfer lines 88, 89 are suspended from the ceiling in upper and lower stages and coupled with each fine spinning machine by means of a movable vertical conveyer 90 to feed full bobbins F doffed by the spinning machine into a full bobbin transfer line 88 and the empty bobbins E on the empty bobbin transfer line 89 to the spinning machine 82.

On the other hand, as shown in FIG. 25, in the case of a conventional vertical conveyer, the conveyer frame

94 should have a lower curved portion 94*a* with a sufficiently large radius R of curvature in order to avoid interference of the full bobbins F with each other, and this often results in difficulties in realizing a compact arrangement. In order to eliminate such a drawback, Japanese Patent Application Laid-open Publication No. 62-180,882 discloses a bobbin transfer apparatus which includes, as shown in FIG. 26, an endless transmission belt 91 extending along a desired path through belt guides and guide pulleys, and a pair of guides 93 are arranged along the transmission belt 91 and maintained in sliding contact with the upper surface of a peg tray 92 so that, with the peg tray resiliently pinched by the transmission belt 91 and the guides 93, the peg tray 92 is moved together with the transmission belt 91. In this case, the guides 93 can be disposed in a twisted manner relative to the transmission belt 91, so that it is possible to alter the posture of empty bobbins E or full bobbins F fitted to the peg 92*a*, and to thereby realize a compact arrangement without particular difficulties.

However, even by combining the teachings of the Japanese Patent Application Laid-open Publication Nos. 62-180,881 and 62-180,882, the vertical conveyer 90 has to be stopped at predetermined positions corresponding to the bobbin transfer paths on both right and left sides of each spinning machine 82, in order to feed empty bobbins E from the empty bobbin transfer line 89 to the spinning machine 82. This means that a considerable time is required to completely deliver full bobbins F and feed empty bobbins E between the spinning machine and the transfer lines 88, 89, and it is thus difficult to improve the productivity. Furthermore, although it may be feasible to suspend from the ceiling a transfer path for coupling the winder station and the fine spinning machines via individual vertical conveyer on both right and left end portions of each spinning machine, provision of independent vertical conveyers for each spinning machine would result in a higher installment cost.

In order to eliminate or at least mitigate the above-mentioned problems of the conventional arrangement, the inventors already made a proposal in non-prepublished Japanese Patent Application No. 63-152,662 regarding an improved bobbin transfer apparatus which will be briefly explained below with reference to FIGS. 27 to 29.

More particularly, the bobbin transfer apparatus according to the inventor's earlier proposal is for a plurality of spinning machines 1 arranged in a juxtaposed relationship, each provided on both right and left sides with transfer devices 2*a*, 2*b* extending in the longitudinal direction of the base of the spinning machine 1, for transferring empty bobbins E and full bobbins F using peg trays 3 each having a peg on the upper surface. A full bobbin transfer conveyer 7 leading to the winder station and an empty bobbin transfer conveyer 8 are suspended from the ceiling above the end portion of the transfer devices 2*a*, 2*b* of each spinning machine, so as to intersect at a substantially right angle with the longitudinal direction of the base of the spinning machine. The apparatus is further provided with a bobbin transfer device 9 for receiving and delivering the bobbins E, F between each transfer device 2*a*, 2*b* and both transfer conveyers 7, 8, at the end portion of the base of each spinning machine. The bobbin transfer device 9 includes an endless belt 10 wound about and extending through a drive pulley 11 and a plurality of guide pulleys 12, and linear guide members 16, 17 disposed along and cooperating with the belt 10 for resiliently engaging with each peg tray 3 by pinching the peg of each peg tray 3. The belt 10 is movable along a path extending through a position corresponding to the end portion of each transfer device *2a*, *2b*, a position along the full bobbin transfer conveyer 7, and a position along the empty bobbin transfer conveyer 8.

As shown in FIGS. 27 and 28, one feature of the bobbin transfer apparatus according to the abovementioned proposal resides in that, at the positions corresponding to the end portion of the guide members 16, 17, the full bobbin transfer conveyer 7 and the empty bobbin transfer conveyer 8 are provided with a full bobbin introducing portion and an empty bobbin delivery portion, respectively, while a limit member is provided at the delivery positive to limit the running direction of the peg tray 3. The limit member is movable between an operating position in which the limit member is brought into engagement with the peg tray, and a waiting position in which the limit member is prohibited from engagement with the peg tray.

However, in case of the above-mentioned arrangement, it is sometimes difficult to reduce the installment cost since the bobbin transfer device 9 has to be provided for each spinning machine 1. Furthermore, more, the transfer devices *2a*, *2b* on both sides of the spinning machine 1 are coupled to each other on the side of a gear end GE of the machine 1 with a coupling rail 6, and the peg trays 3 are fed into one transfer device *2a* from the side of the other transfer device *2b*. This means that, during doffing of the spinning machine in which full bobbins F and empty bobbins E are exchanged with a tube exchange unit, the bobbins on the coupling rail 6 are not exchanged and are thus useless.

Another feature of the bobbin transfer apparatus according to the above-mentioned proposal resides, as shown in FIGS. 27 and 29, in that both transfer conveyers 7, 8 are provided, at predetermined positions corresponding to the end portion of each spinning machine, with the full bobbin introducing portion and the empty bobbin delivery portion. In order to receive and deliver the bobbins between each transfer device *2a*, *2b* and both transfer conveyers 7, 8, a rail 24 is arranged on one side of each spinning machine 1 to extend in the direction intersecting at a right angle with the longitudinal direction of the spinning machine. The bobbin transfer device 9 including an endless belt 10 and linear guide members 16, 17, as mentioned above, is mounted on a vehicle body 25 which is movable along the rail 24. The bobbin transfer device 9 is provided with full bobbin delivery portion and empty bobbin introducing portion at positions corresponding to the full bobbin introducing portion and the empty bobbin delivery portion of both transfer conveyers 7 and 8.

In this case, a single bobbin transfer device 9 serves to transfer bobbins to and from a plurality of spinning machines, and the installment cost can thus be reduced. However, due to a variety of size at the gear end GE of the spinning machine, in case of the bobbin transfer device 9 intended for coupling the transfer devices *2a*, *2b* on both sides of the spinning machine 1 with the bobbin transfer conveyers 7, 8 suspended from the ceiling, when the bobbin transfer device 9 is to be coupled with existing spinning machines, the manner of coupling the bobbin transfer device 9 to both transfer devices *2a*, *2b* is not always the same, and they must be aligned with each other at the site on a case-by-case basis, thereby accompanying troublesome work and increased cost.

SUMMARY OF THE INVENTION

It is an object of the present invention to provide an improved bobbin transfer apparatus which is capable of eliminating or at least mitigating the drawbacks mentioned above.

To this end, according to the present invention, there is provided an apparatus for transferring empty and full bobbins to and from a plurality of spinning machines which are arranged in a juxtaposed relationship with their respective longitudinal directions in parallel with each other, said bobbins being transferred by using a plurality of peg trays each having an upper surface with a peg projecting therefrom, comprising: stationary bobbin transfer devices for transferring bobbins, arranged on both sides of and in a longitudinal direction of each spinning machine; a full bobbin transfer conveyer leading to a subsequent station and an empty bobbin transfer conveyer, both being supported by a ceiling so as to intersect at a substantially right angle to the longitudinal direction of the spinning machines, above end portion of the stationary bobbin transfer devices of each spinning machine; and a movable bobbin transfer device including an endless belt wound about and extending between a driving pulley and a plurality of guide pulleys, and linear guide members disposed along and cooperating with said belt for resiliently engaging with each peg tray by pinching the peg thereof, said movable bobbin transfer device being arranged so as to be movable along said conveyers supported by the ceiling to receive empty bobbins from said empty bobbin transfer conveyer and deliver full bobbins to said full bobbin transfer conveyers, said movable bobbin transfer device having a lower end portion which is pivotally connected on both sides thereof with respective one ends of bobbin transfer bridges, said bobbin transfer bridges being rotatable such that free end portions of said bridges can be respectively coupled to said stationary bobbin transfer devices of selected one of said spinning machines.

With the above-mentioned arrangement of the present invention, a single movable bobbin transfer device can perform reception and delivery of the bobbins to and from the plurality of spinning machines. It is thus possible to remarkably reduce the installment cost as compared with the conventional ones wherein each spinning machine is associated with a individual bobbin transfer device. Furthermore, according to the present invention, the movable bobbin transfer device is connected with the stationary bobbin transfer devices on both sides of the spinning machine via the bobbin transfer bridges pivotally supported at the lower end portion of the movable bobbin transfer device. The movable bobbin transfer device can be readily adapted to various types of spinning machines, including existing machines, simply by adjusting the bridge in its length or the like.

According to one preferred embodiment of the present invention, a traveling rail is provided parallel to the bobbin transfer conveyers on the ceiling, and arranged such that the movable bobbin transfer device can be moved along the traveling rail. In this case, it is possible to precisely maintain the distance between the rail and the bobbin transfer conveyer, with the result that the bobbins can be reliably received and delivered.

The movable bobbin transfer device may include a frame which is movable along the traveling rail and suspended to extend downwardly close to a floor surface, a support having a lower end portion pivotally supported by the frame, and an upper portion which can be moved toward and away from the bobbin transfer conveyers on the ceiling. In this case, even when some obstacle is present on the passage along which the movable bobbin transfer device is guided, it is readily possible to tilt the movable bobbin transfer device outwardly together with the support to bypass the obstacle for an undisturbed passage. The result in a facilitated design in the arrangement of the entire apparatus.

According to another embodiment of the present invention, the stationary bobbin transfer devices on both sides of the spinning machine each includes an endless belt with one end portion to be opposed to the free end portion of a corresponding bobbin transfer bridge and associated with a pulley, the free end portions of the bobbin transfer bridges being each rotatable in horizontal and vertical planes and provided with a pulley which can be detachably fitted with the pulley of the stationary bobbin transfer device such that the endless belt of the stationary bobbin transfer device can be driven by the pulley of the bridge. In this case, the free end portion of the bridge can be readily centered with reference to the end portion of the stationary bobbin transfer device. Furthermore, since it is not necessary to provide a driving unit at each stationary bobbin transfer device, it is readily possible to realize a simple and reliable structure.

By actuating the motor to drive the bobbin transfer bridge either in normal or reverse direction, the bobbin can be transferred via the bridge to and from the stationary bobbin transfer device. Thus, according to the present invention, the stationary bobbin transfer devices on both sides of the spinning machine need not be connected to the coupling rail on one end portion, so that the bobbins on the coupling rail are not wasted.

According to the another embodiment of the present invention, each bobbin transfer conveyer on the ceiling is guided by a guide rail having a side edge which is formed with a cutout at a bobbin receiving and delivering portion between the bobbin transfer conveyer and said movable bobbin transfer device, the side edge being provided with a swing guide adjacent to said cutout for preventing drop of a tray, which can be maintained in its closed position by means of a spring, the linear guide members of the movable bobbin transfer device each having an end portion opposed to said swing guide and curved toward the bobbin transfer conveyer such that, when said movable bobbin transfer device approaches the conveyer, the end portion of said linear guide member pushes the swing guide to open it against said spring for allowing the bobbins to be received and delivered across said cutout. By this, the reception and delivery of the bobbins can be ensured with a simple arrangement by opening the swing guide, while the cutout of the guide rail is blocked by the swing guide in its closed position to prevent drop of the bobbin.

According to another embodiment of the present invention, the movable bobbin transfer device includes a lower end portion having outer side regions each provided with a first pulley supported on a vertical shaft for passing a peg tray transfer belt therethrough, a second pulley supported on a horizontal shaft on outer side of the first pulley, and arranged at a junction where the bridge is pivotally supported, a third pulley arranged at the free end of the bridge so that another peg tray transfer belt is passed through the second and third pulleys, the peg tray transfer belts cooperating with each other to form a passage extending along a semi-circular path around the first pulley for guiding the peg trays from the bridge, the first pulleys each being coaxially provided with a switching guide having a protrusion on its outer periphery, the switching guide being angularly movable between a first operational position for allowing passages of the peg trays, and a second operational position in which the protrusion inhibits the passage of the peg trays. In this case, the full bobbins collected on the stationary bobbin transfer bridge at either side of the spinning machine can be fed into the full bobbin transfer conveyer suspended from the ceiling via the bobbin transfer bridges and the movable bobbin transfer device, and the empty bobbins of the empty bobbin transfer conveyer can subsequently be fed onto the stationary bobbin transfer device at either side of the spinning machine via the movable bobbin transfer device and the bobbin transfer bridge.

As described above, when the bobbins have been received or delivered on one side of the spinning machine, the bobbins on the fixed bobbin transfer device on the other side of the machine can also be received or delivered in a similar manner.

DETAILED EXPLANATION OF THE PREFERRED EMBODIMENTS

Figure 1:
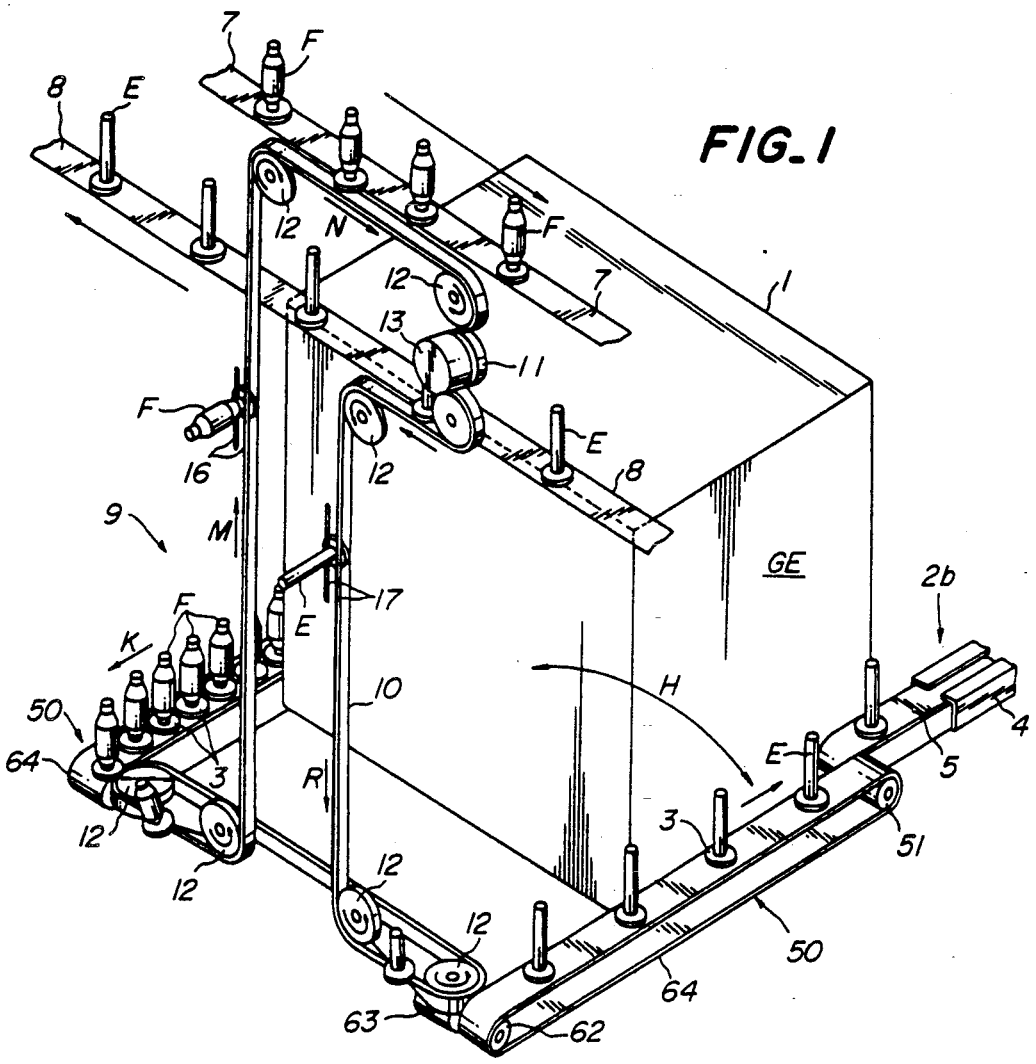
FIG. 1 is a perspective view schematically illustrating a bobbin transfer apparatus according to the present invention.

The present invention will now be explained in further detail, by referring to some preferred embodiments shown in FIGS. 1 to 22. For the sake of simplicity, same reference numerals are used throughout the figures to denote like components or elements.

Figure 2:
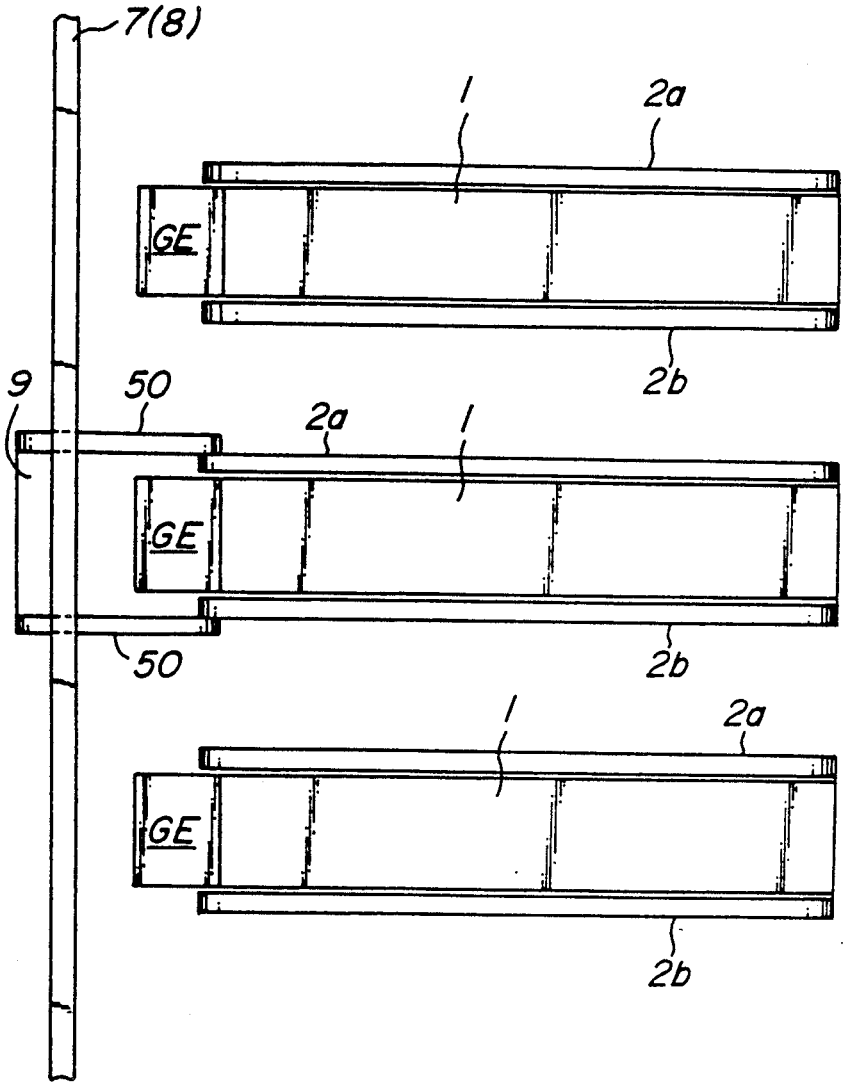
FIG. 2 is a plan view illustrating the relationship between the apparatus according to the present invention and spinning machines arranged in a juxtaposed relationship.
Figure 4:
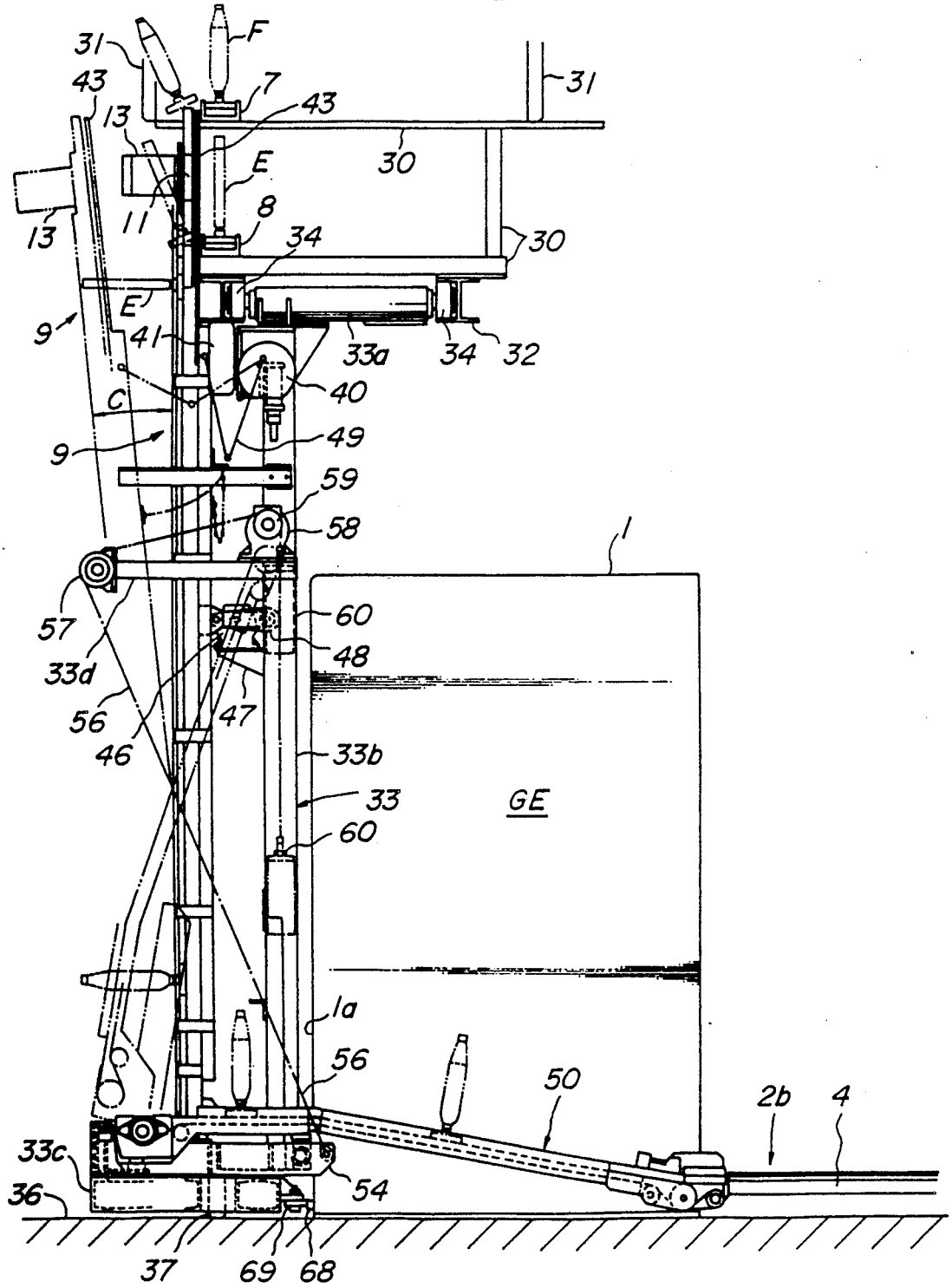
FIG. 4 is a side view thereof.
Figure 11A:
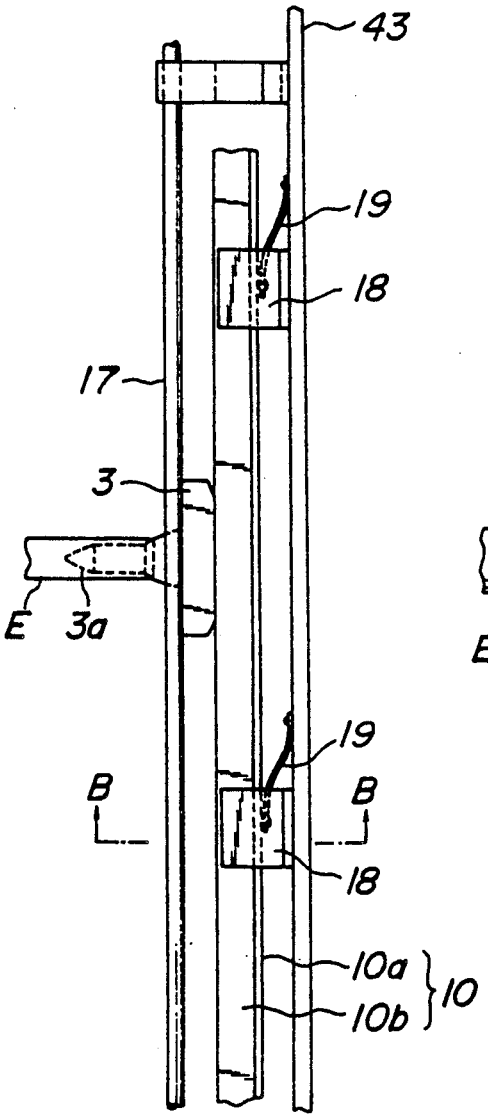
FIG. 11*a* is a side view of a vertical transfer portion of the movable bobbin transfer device.
Figure 11B:
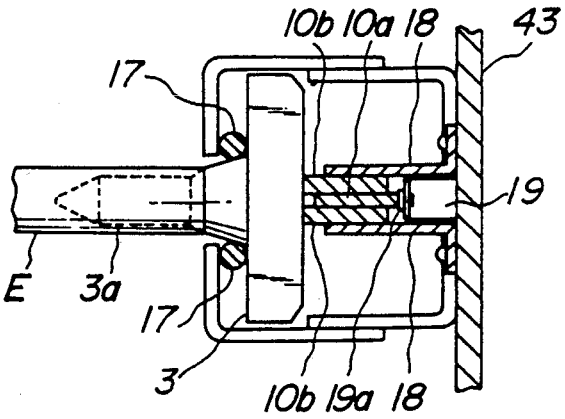
FIG. 11*b* is a cross-sectional view taken along the line B—B of FIG. 11*a*.
Figure 22:
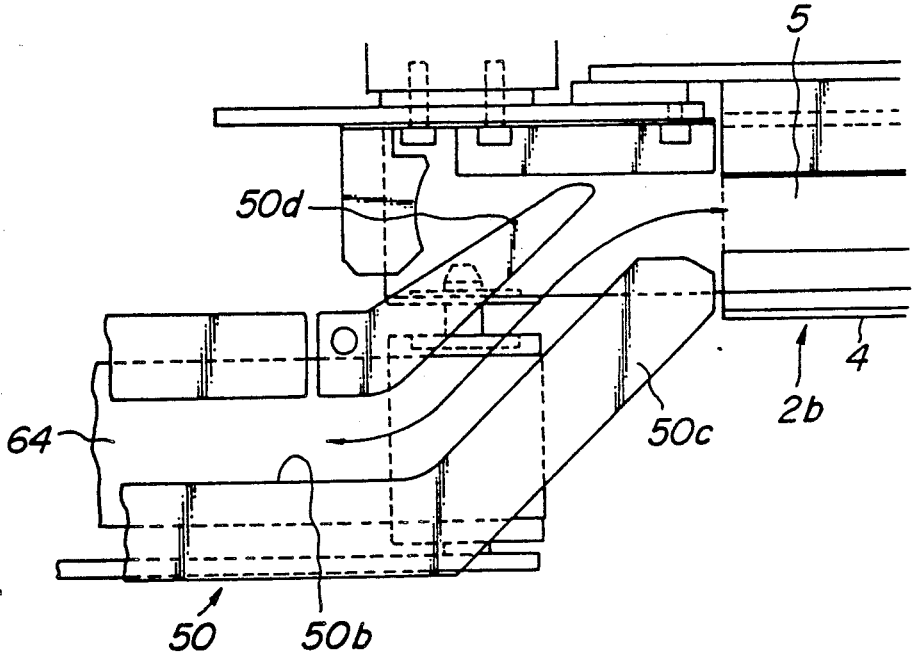
FIG. 22 is a plan view illustrating the connection between the bobbin transfer bridge and the stationary bobbin transfer device.
Figure 23:
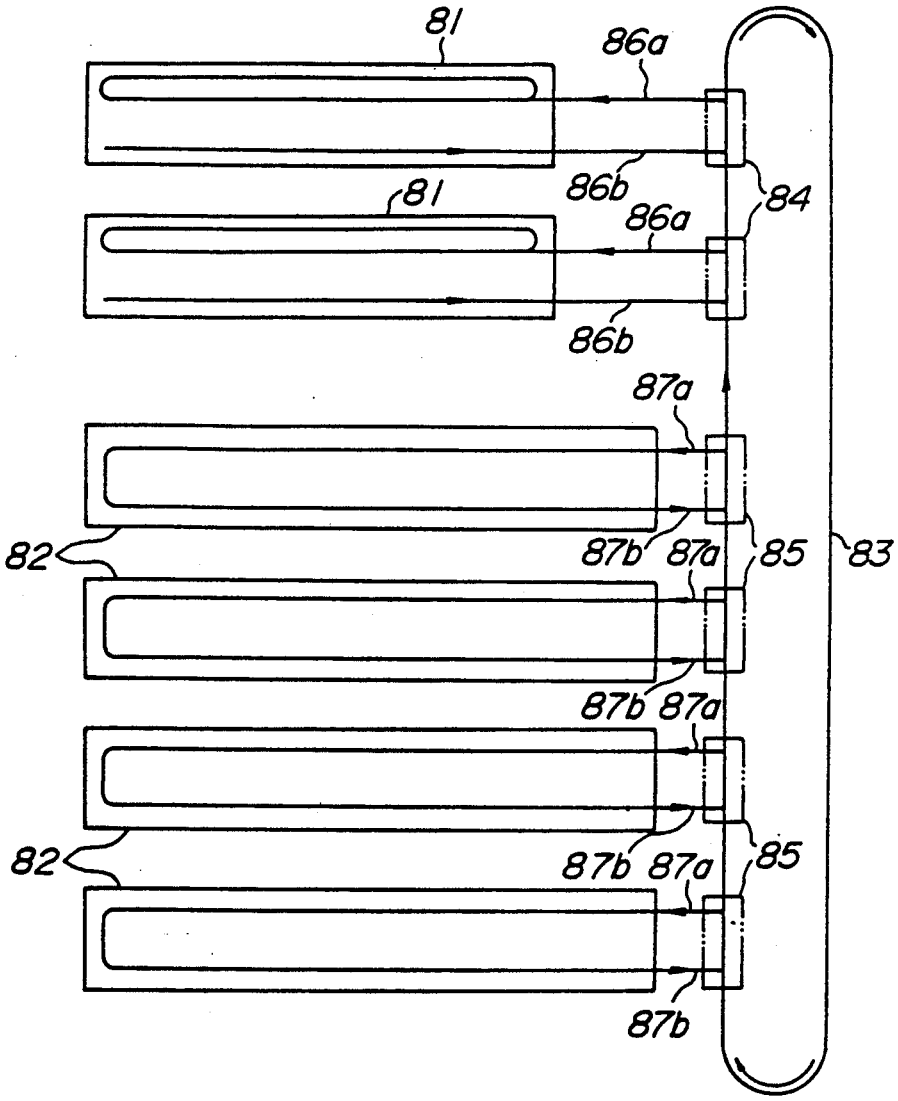
FIG. 23 is a plan view schematically illustrating one example of conventional bobbin transfer apparatus.
Figure 24:
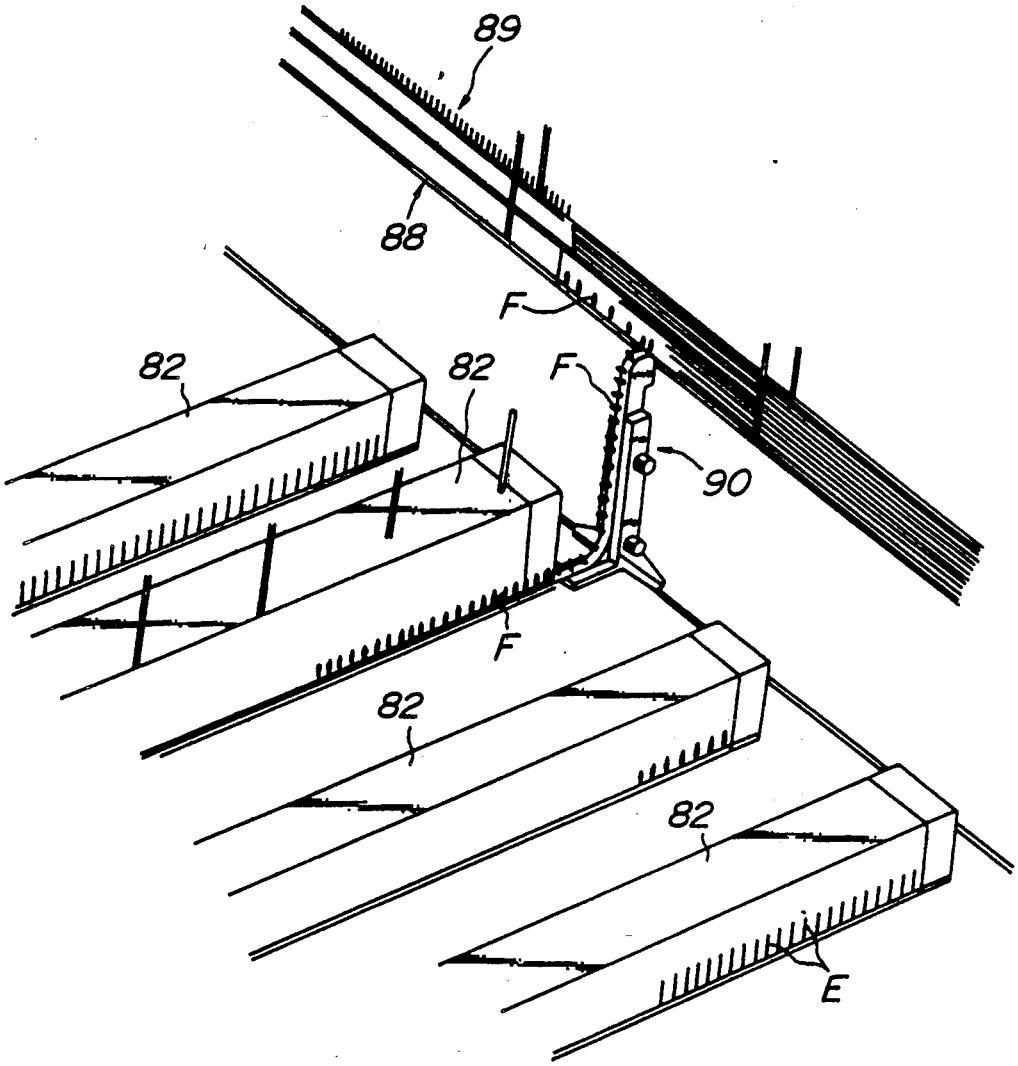
FIG. 24 is a perspective view schematically illustrating another example of conventional apparatus.
Figure 25:
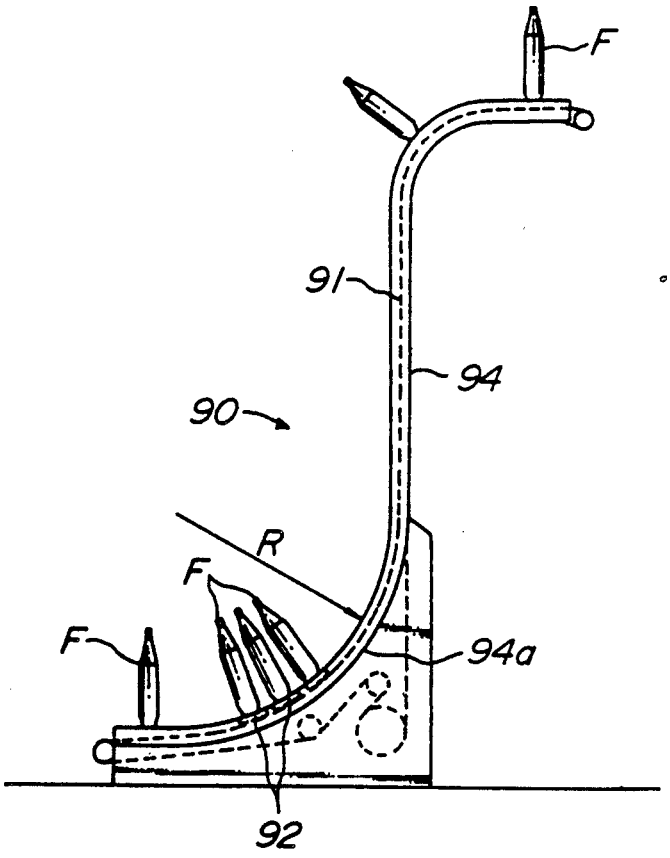
FIG. 25 is a partial perspective view thereof.
Figure 26:
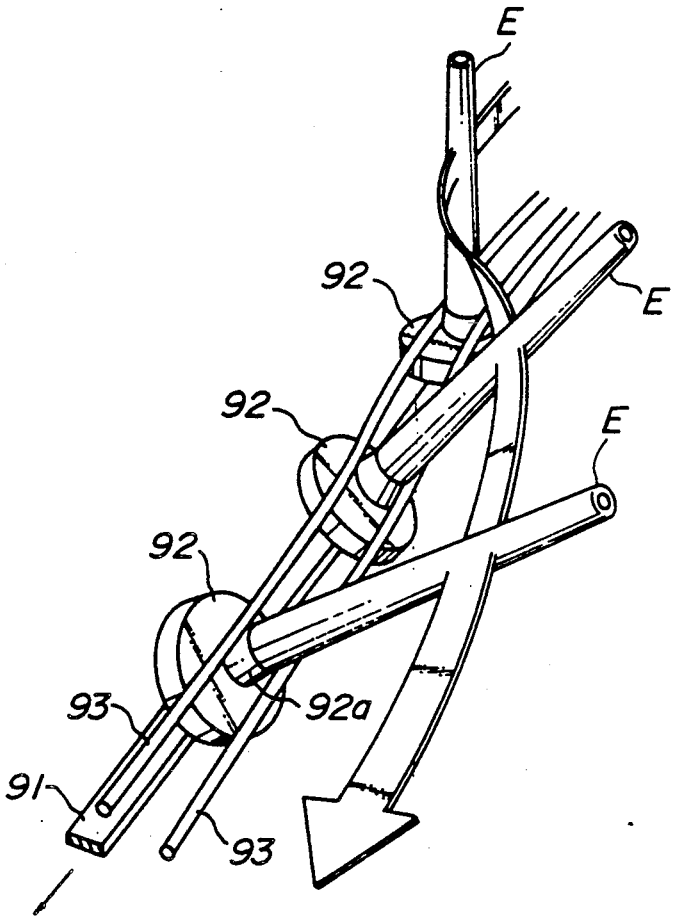
FIG. 26 is a partial perspective view of another example of conventional apparatus.
Figure 27:
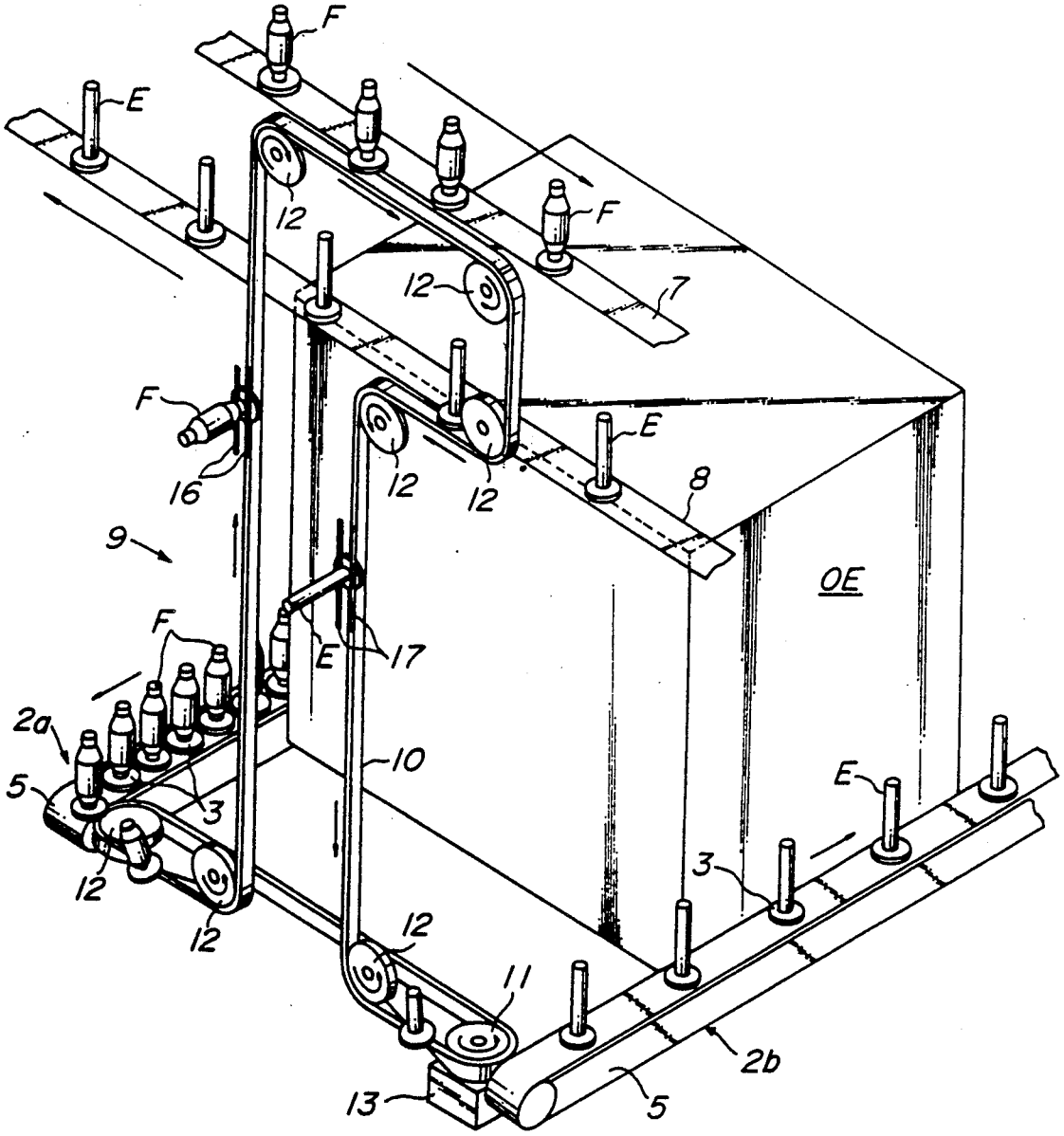
FIG. 27 is a perspective view schematically illustrating another example of conventional apparatus.
Figure 28:
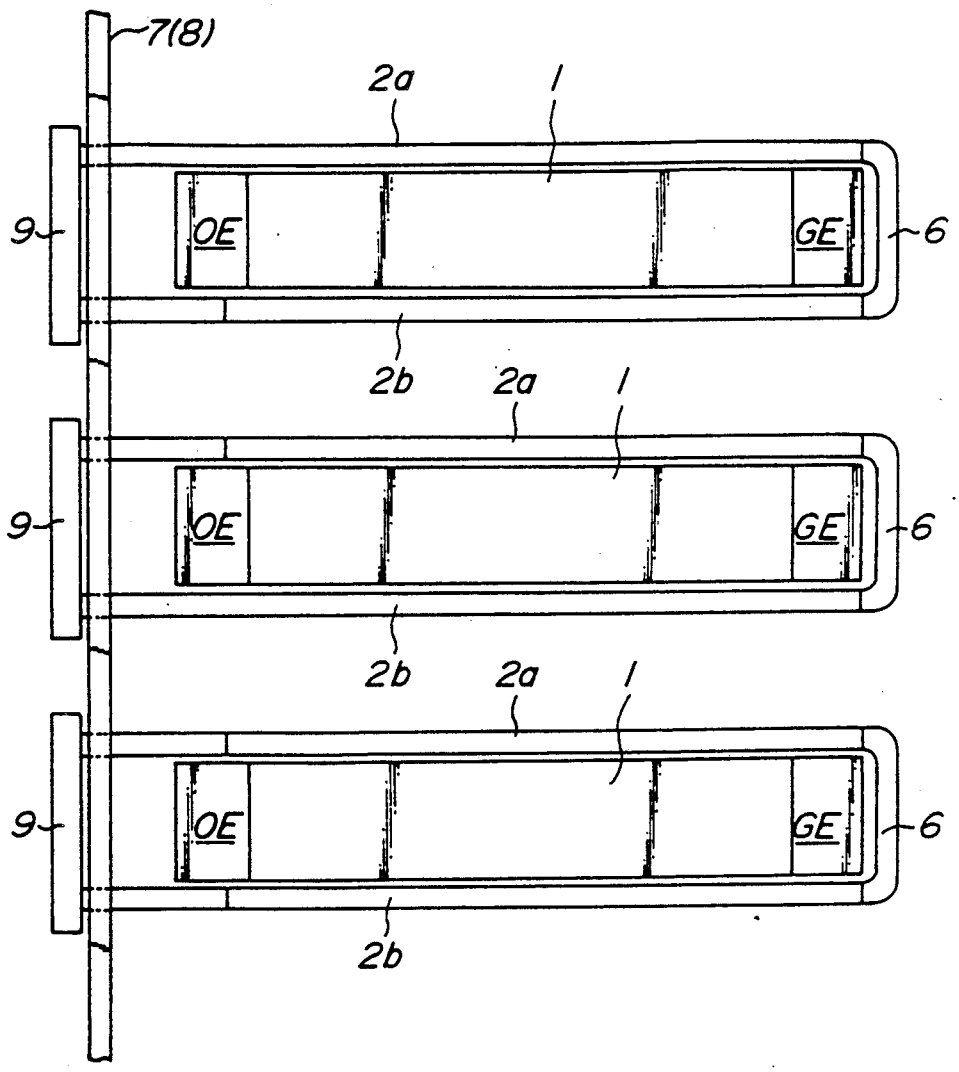
FIG. 28 is a plan view illustrating the relationship between a series of spinning machines and the apparatus of FIG. 27.
Figure 29:
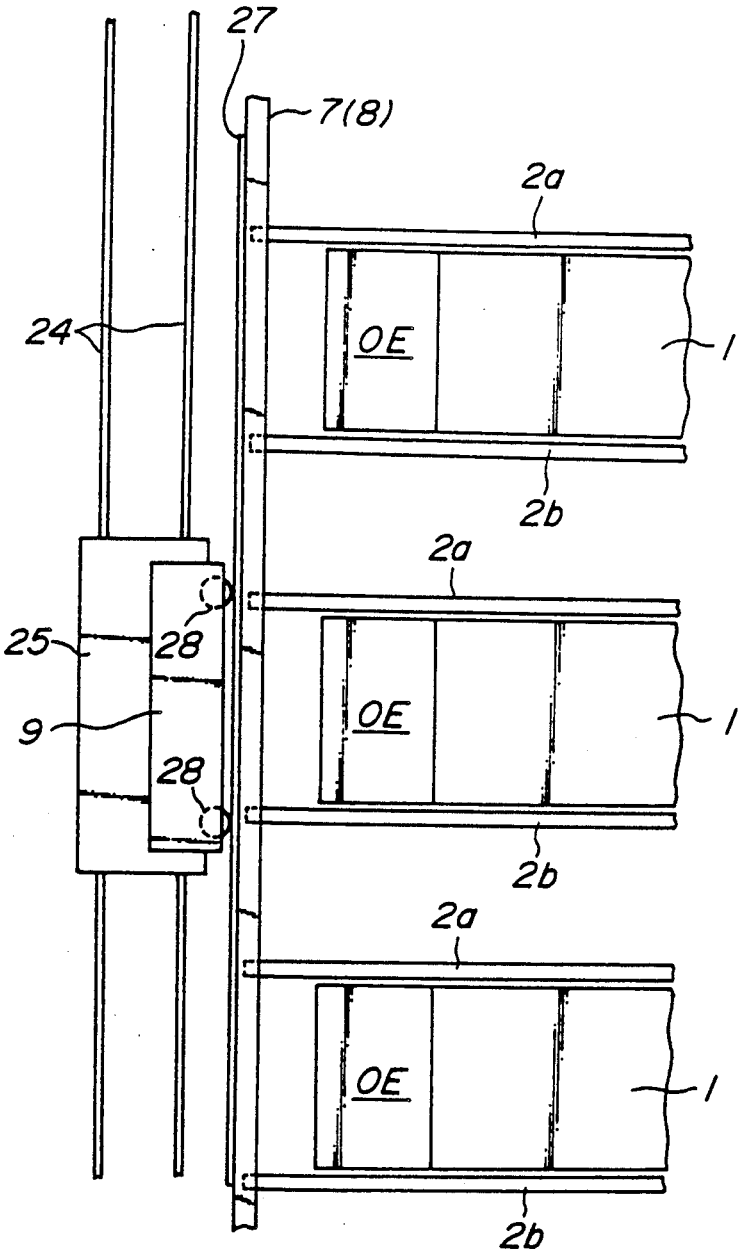
FIG. 29 is a plan view illustrating the relationship between a series of spinning machines and another example of conventional apparatus.

The present invention provides a bobbin transfer apparatus which is applied to an arrangement wherein a series of spinning machines are arranged in a juxtaposed relationship. According to one preferred embodiment of the present invention, as shown in FIG. 2, on both right and left sides of each spinning machine 1, there are provided stationary bobbin transfer devices 2*a*, 2*b* which are arranged independently from each other, extending along the spinning machine 1 in the longitudinal direction thereof. As shown in FIG. 1, the stationary bobbin transfer devices 2*a*, 2*b* serve to transfer empty bobbins E and full bobbins F, using peg trays 3 each having an upper surface which is provided with a peg 3*a* protruding upwardly therefrom, as shown in FIG. 11. To this end, as shown in FIGS. 1, 4 and 22, the stationary bobbin transfer devices 2*a*, 2*b* each comprises a guide rail 4 for guiding the peg trays 3, and a belt conveyer 5 for carrying the peg trays 3. As shown in FIGS. 1 and 2, above the gear end GE of the spinning machine 1, there are provided a full bobbin transfer conveyer 7 leading to a subsequent station, such as winding station or the like and an empty bobbin transfer conveyer 8 leading to a selected one of the spinning machines. The bobbin transfer conveyers 7, 8 are arranged in parallel with each other, intersecting substantially at right angle to the longitudinal direction of the machine 1. As shown by arrows in FIG. 1, the bobbin transfer conveyers 7, 8 are moved in opposite directions to each other.

On the outer side of the gear end GE of the machine 1, there is provided a movable bobbin transfer device 9 for exchanging the full and empty bobbins F and E between the transfer devices 2*a*, 2*b* and the bobbin transfer conveyers 7, 8. The movable bobbin transfer device 9 includes a belt 10 which is wound about and extending between a drive pulley 11 and a number of guide pulleys 12, and which cooperates with linear guide members 16 and 17 to engage with and transfer the peg trays 3. The drive pulley 11 is connected to a motor 13 so that the belt 10 can be driven to move along a predetermined path. The path of the belt 10 includes a horizontal section substantially on the same level as the stationary bobbin transfer devices 2*a* and 2*b*, extending in the direction intersecting at right angle to stationary bobbin transfer devices 2*a* and 2*b* at an adjacent position corresponding to the extension of the stationary bobbin transfer devices 2*a*, 2*b*, a vertical section running up to the substantially same level as the full bobbin transfer conveyer 7 on inside of the stationary bobbin transfer devices 2*a*, 2*b*, a horizontal section running parallel through the adjacent position along the full bobbin transfer conveyer 7 at the substantially same level as the latter, a horizontal section running parallel through an adjacent position along the empty bobbin transfer conveyer 8 on substantially the same level, and a vertical section running up to the same level as the stationary bobbin transfer devices 2*a*, 2*b* from the level of the empty bobbin transfer conveyer 8. The sections of the belt 10 running parallel to the full bobbin transfer conveyer 7 and the empty bobbin transfer conveyer 8 are arranged so that they can be driven in the same directions as the transfer directions of both bobbin transfer conveyers 7 and 8, respectively.

There is illustrated in FIGS. 3 to 6 one practical example of the apparatus according t the present invention, in which the full bobbin transfer conveyer 7 and the empty bobbin transfer conveyer 8 are disposed in parallel with each other, respectively on upper and lower sides of a framework 30 which is suspended from a ceiling by means of suspension members 31, as shown in FIG. 4.

Beneath the framework 30, two traveling rails 32 consisting of H-shaped beams are provided in parallel with the conveyer 7 and 8, for guiding a movable frame 33. The movable frame 33 has an upper frame section 33*a* which is arranged between the rails 32 and provided with four vertical rollers 34 and four horizontal rollers 35. Below the upper frame 33*a*, two columnar members 33*b* with a square cross-section are protruded downwardly, whose lower end portion is fixedly connected to a lower frame section 33*c* which is spaced from the floor surface 36 leaving a minor clearance therebetween. The lower frame section 33*c* is provided with two wheels 37 which are urged by springs 38 into rolling contact with the floor surface 36. Each wheel 37 is further associated with a wheel support 39 and a fulcrum 39*a*. Another frame section 33*d* protrudes from the columnar member 33*b* and the lower frame section 33*c*, and the movable frame 33 is integrally formed of these members 33*a* to 33*d*.

Below the upper frame section 33*a* of the movable frame 33, there is arranged a geared motor 40 with a braking device. The motor 40 serves to drive the movable frame 33 and is connected to a roller 41 which is resiliently urged by a spring 42 into contact with the lower surface of the traveling rail 32.

Figure 3:
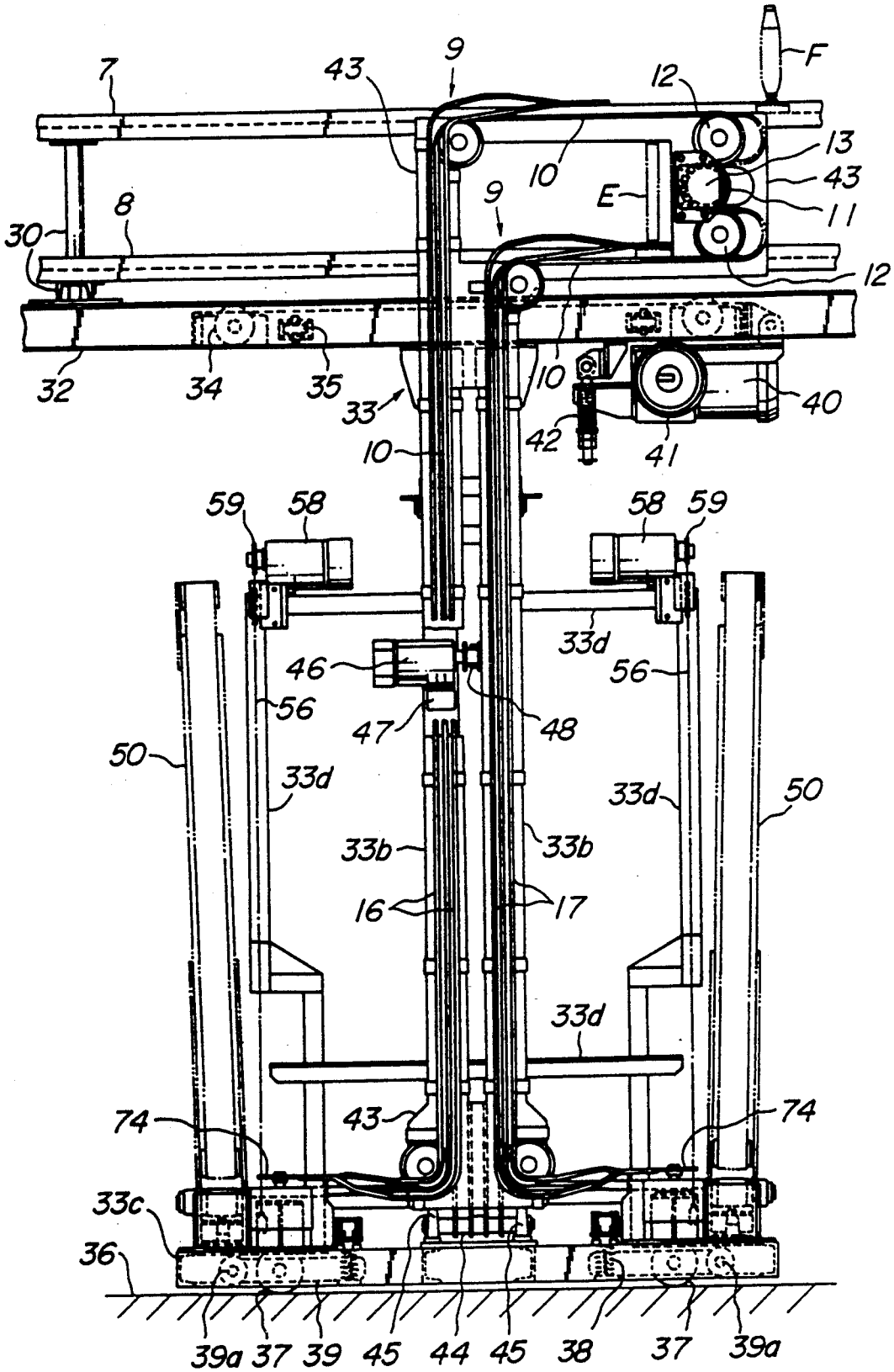
FIG. 3 is a plan view illustrating one preferred embodiment of the apparatus according to the present invention.

There is further provided a plate-shaped support 43 which serves as a base for mounting various elements of the movable bobbin transfer device 9. The support 43 includes a lower end portion which is pivotally supported by a shaft 44 and bearings 45. As shown in FIG. 3, the upper portion of the support 43 is adapted to tilt about the axis of the shaft 44, as indicated by arrow C in FIG. 4.

More particularly, for controlling the tilting motion of the support 43, there is provided a geared motor 46 with a braking device, which is arranged on a bracket 47 protruding from the middle portion of the frame 33. The shaft of the motor 46 and the support 43 are coupled with each other by means of a double-link element 48, so that actuation of the motor 46 results in the above-mentioned pivotal tilting movement of the support 43 indicated by arrow C by the action of the link element 48. Incidentally, as shown in FIG. 4, there is interposed a double-link guide device 49 between the support 43 and the frame 33.

Furthermore, as shown in FIGS. 1 to 6, there is provided a bobbin transfer bridge 50 on the outer side of the driving pulley 11 and the guide pulleys 12 which, as mentioned hereinbefore, are arranged on both sides of the lower end of the movable bobbin transfer device 9. The bobbin transfer bridge 50 has one end portion which is pivotally connected to appropriate location so that its free end portion is rotatable in both vertical and horizontal planes. The bridge 50 is provided on the free end portion with a pulley 51, while each stationary bobbin transfer device **2*a*, 2*b* is provided on the opposite end portion with a pulley 52. The center portions of the pulleys 51, 52 are adapted to detachably fit with each other so that the belt of each stationary bobbin transfer devices 2*a*, 2*b* can be driven by the bridge 50 through the pulleys 51, 52**.

More particularly, the lower frame section **33*c* of the frame 33 is formed with brackets 33*e* protruding from both sides thereof, and one end portion of a bridge support member 54 is pivotally supported on the respective brackets 33*e* by means of horizontal shafts 53. A chain 56 is connected to a shaft 55 protruding from the free end portion of the bridge support member 54, and is passed through a sprocket 57 supported on the frame section 33*d* of the frame 33. The chain 56 is further wound about a sprocket 59 connected to the shaft of a geared motor 58 which, in turn, is connected to the frame section 33*d*. By driving the chain 56 in normal or reverse direction, the free end portion of the bridge support member 54 is made rotatable. A counterweight 60 is coupled to the end portion of the chain 56**.

Furthermore, a vertical shaft 61 is provided adjacent to the proximal portion of the bridge support member 54 to thereby pivotally support the proximal portion of the frame **50*a* of the bobbin transfer bridge 50, and to thereby allow the free end portion of the bridge 50** to be rotated by a certain angular range in a horizontal plane.

Figure 5:
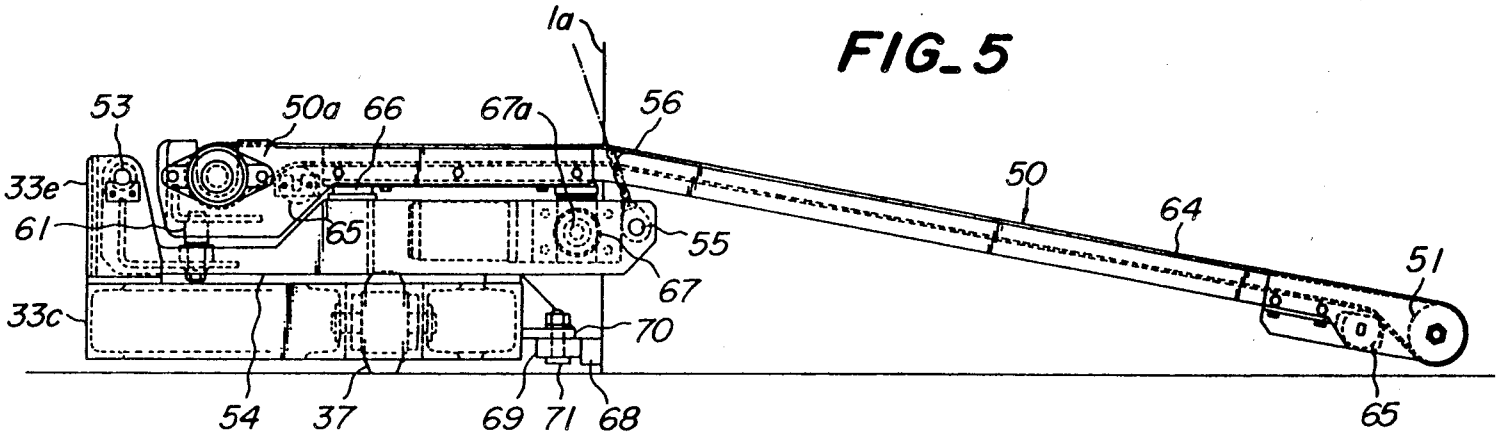
FIG. 5 is a fragmentary side view illustrating a portion of FIG. 4 in an enlarged scale.
Figure 6:
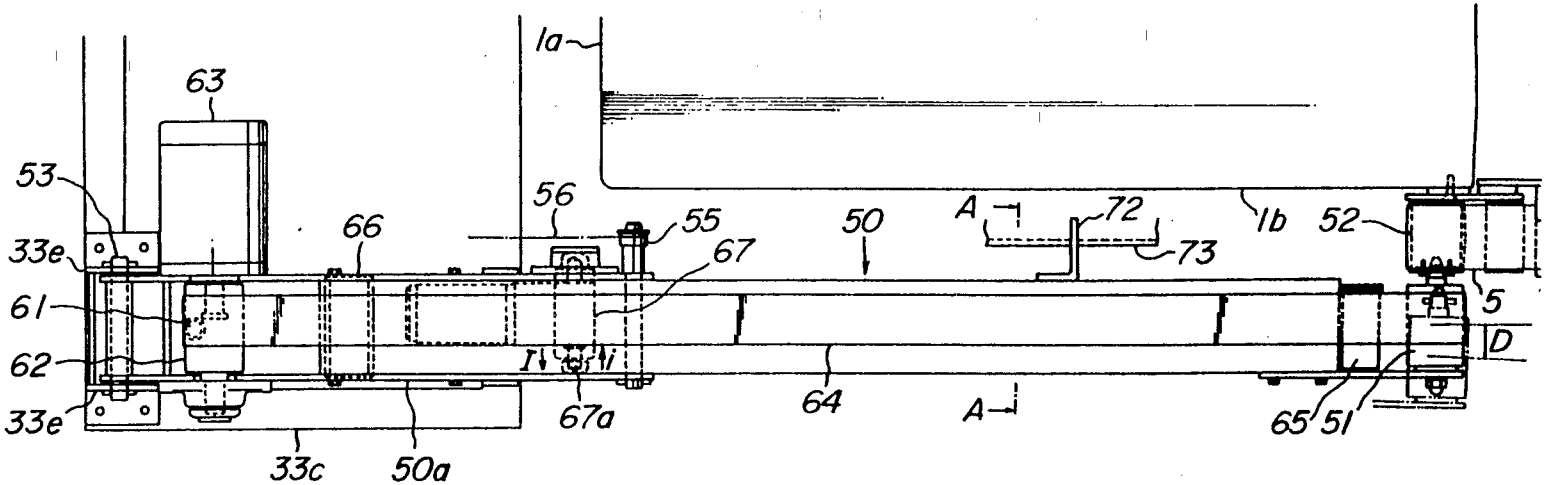
FIG. 6 is a plan view thereof.

As particularly shown in FIGS. 5 and 6, a driving pulley 62 is arranged on the proximal portion of the frame **50*a* of the bobbin transfer bridge 50, so that it can be driven by a geared motor 63 which is arranged on the inner side of the frame 50*a*. A belt 64 is arranged to extend between the pulley 62 and the pulley 51 which, as mentioned above, is arranged on the tip end of the bridge 50. The belt 64 is associated with a tension pulley 65**.

Bridge pads 66 are provided between the bridge support frame 54 and the frame **50*a* of the bobbin transfer bridge 50. A linear motor 67 is arranged to protrude from the lower surface of the frame 50*a* of the bridge 50 so that both lateral end portions of the motor 67 can be brought into abutment with opposite internal walls of the bridge supporting member 54. To this end, the linear motor 67 includes actuator elements 67*a* protruding from both sides thereof and arranged such that lateral movement of the actuator 67*a* allows the free end portion of the bridge 50 to be put into a rocking motion, as indicated by arrow D in FIG. 6**.

Figure 7:
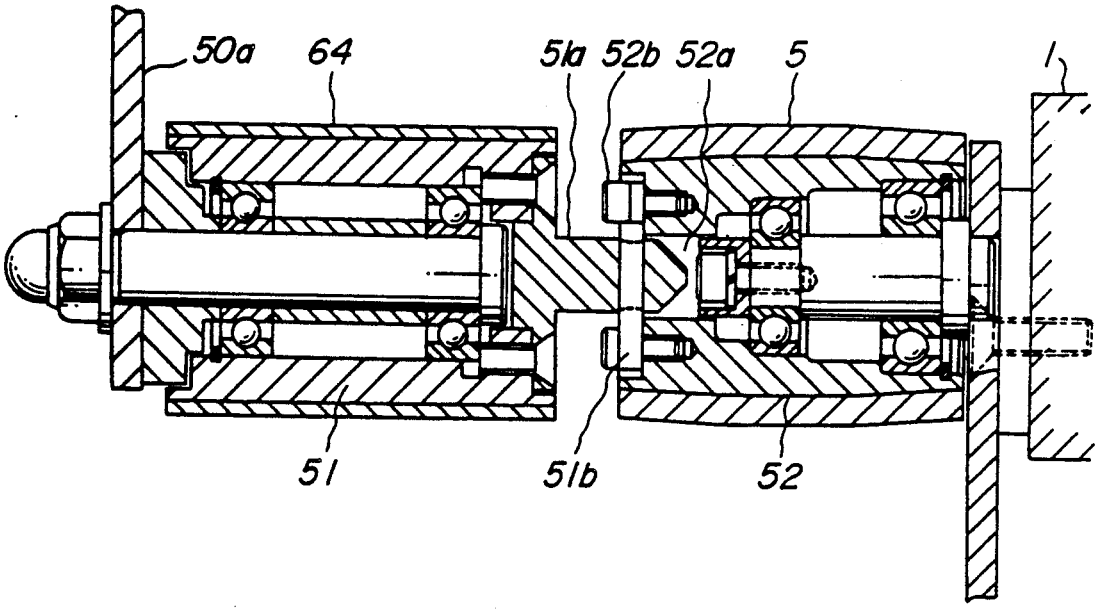
FIG. 7 is a cross sectional view illustrating a state in which a bobbin transfer bridge is coupled with a stationary bobbin transfer device.
Figure 8:
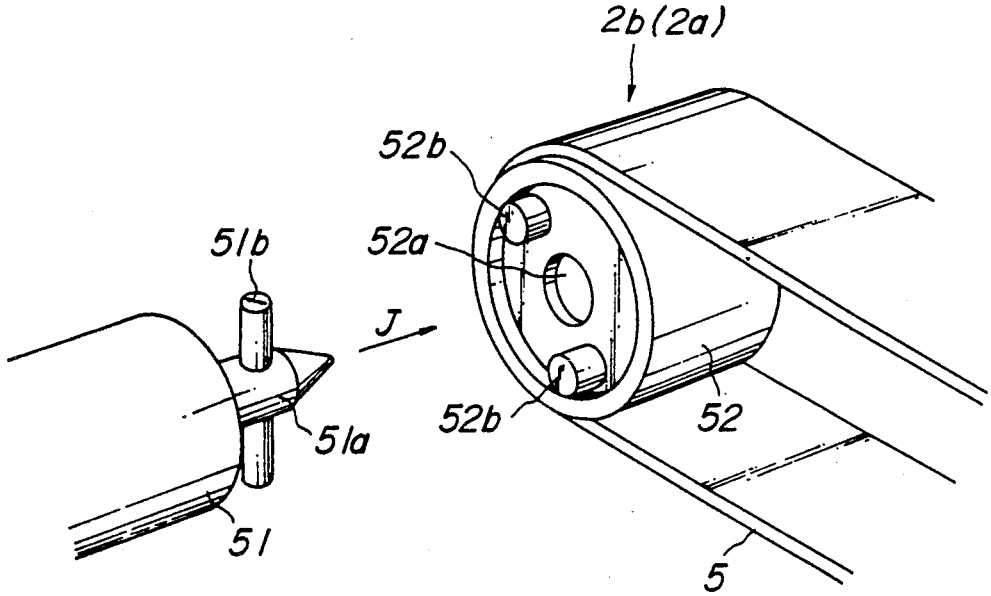
FIG. 8 is a perspective view illustrating a state prior to the coupling of the bobbin transfer bridge and the stationary bobbin transfer device.

Furthermore, as shown in FIGS. 7 and 8, the pulley 51 is provided, on its side surface opposite to the machine 1, with a pin **51*a* having a pointed end, which protrudes from the center of the side surface of the pulley 51, and also with rods 51*b* intersecting at a right angle with the pin 51*a*. On the other hand, the pulley 52 at the end portion of each stationary bobbin transfer device 2*a*, 2*b* is provided, on its outer side surface, with a center hole 52*a* into which the abovementioned pin 51*a* can be fitted, and also with engaging pins 52*b* for engaging the rods 51*b*** to transmit rotation.

In order to align the pin **51*a* with the center hole 52*a*, as shown in FIGS. 4 and 5, a guide rail 68 intersecting at a right angle with the longitudinal direction of the machine 1 is horizontally protruded at the lower portion of the side wall surface 1*a* on the side of the gear end of the machine 1. On the other hand, a plurality of rollers 69 to be brought into contact with the guide rail 68 are rotatably mounted on brackets 70 via shafts 71, which brackets are provided to protrude from the surface of the lower frame section 33*c* opposed to the machine 1**.

Figure 9:
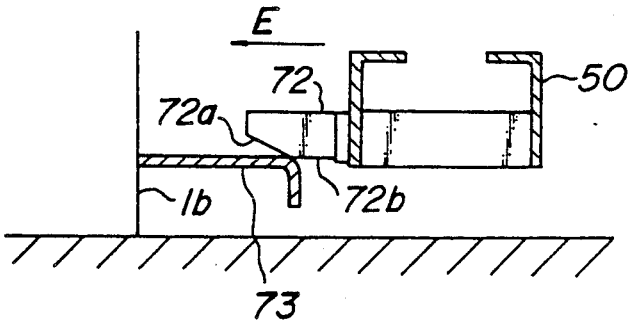
FIG. 9 is a cross-sectional view taken along the line A—A of FIG. 6.

Furthermore, the side surface of the bobbin transfer bridge 50 opposed to the machine 1 is provided, as shown in FIGS. 6 and 9, with a guide plate 72 having a lower edge whose tip end portion **72*a* is upwardly tilted. A horizontal reference plate 73 engaging the guide plate 72 is protruded from the wall surface 1*b* of the machine 1** on the side of the bridge.

When the rollers 69 are brought into contact with the guide rail 68, the bobbin transfer bridge 50 is moved, as indicated by arrow E in FIG. 9, and the horizontal portion **72*b* of the lower edge of the guide plate 72 runs over the upper surface of the horizontal reference plate 73. On this occasion, the pin 51*a* shown in FIG. 8 fits into the center hole 52*a* of the opposite pulley 52, as shown in FIG. 7. In this case, since the rod 51*b* is brought into engagement with the engaging pin 52*b*, the rotation of the pulley 51 can be transmitted to the pulley 52**.

FIGS. 10 to 16 illustrate the details of the above-mentioned movable bobbin transfer device 9. As shown in FIGS. **11*a* and 11*b*, the belt 10 is formed of a flat belt which includes a slidable center core band 10*a* of a low-frictional material, and rubber layers 10*b* formed of a high frictional rubber material and disposed on both sides of the core band 10*a*. The core band 10*a* and the rubber layers 10*b* are laminated with each other, with one end of the core band 10*a* protruding from the rubber layers 10*b*. Each peg tray 3 is moved together with the belt 10, with its bottom surface in pressure contact with the rubber layer 10*b* of the belt 10. Along the regions where the belt 10 extends in a vertical direction, the peg tray 3 is moved contacting the rubber layer 10*b* of the belt 10 on the side opposite to the core band 10*a*. In these regions, the support 43 is provided with pairs of guide pieces 18 for pinching and guiding the belt 10 therebetween, at a predetermined distance in the longitudinal direction of the support 43. Similarly, leaf springs 19 are arranged at a predetermined distance in the longitudinal direction of the support 43 so that the leaf springs 19 can be brought into contact with the core band 10***a* to urge the belt 10 in its width direction, i.e. toward the guide members 16, 17. The leaf springs 19 are made to contact the core band 10*a* via a contact portion 19*a* formed of an anti-frictional material such as ceramics, instead of directly contacting the core band 10*a*. Although the belt 10 is urged by the leaf springs 19 in the width direction of the belt 10, it is possible to prevent disengagement of the belt 10 from the guide pulley 12 when the pulley 12 is formed to have a width which is greater than that of the belt 10.

Figure 10:
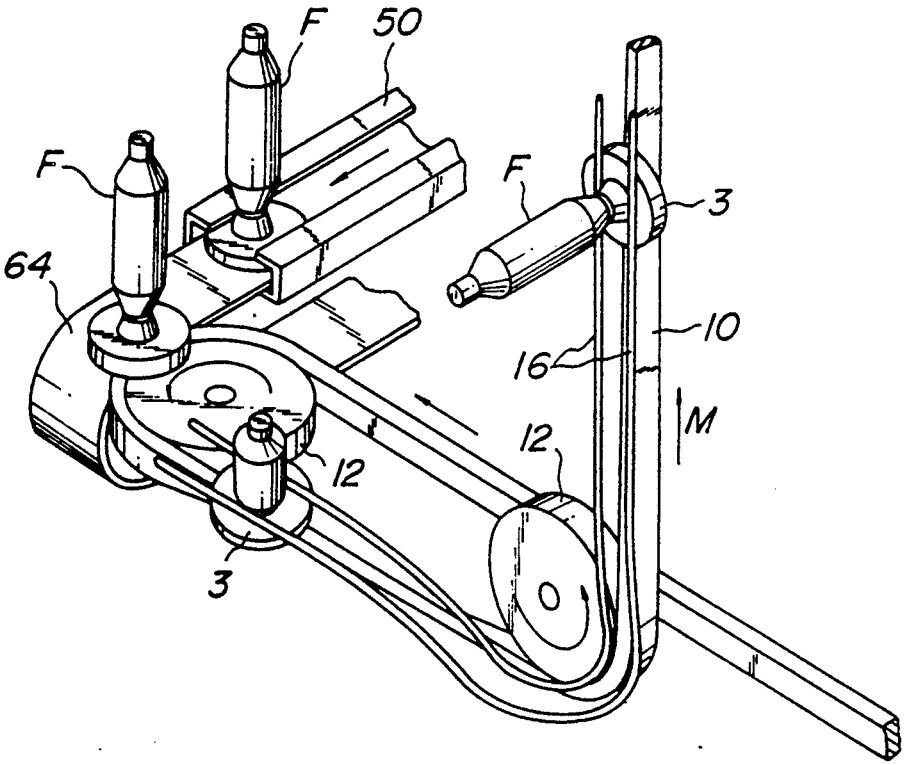
FIG. 10 is a partial perspective view illustrating the leftside lower portion of a movable bobbin transfer device shown in FIG. 1.
Figure 16:
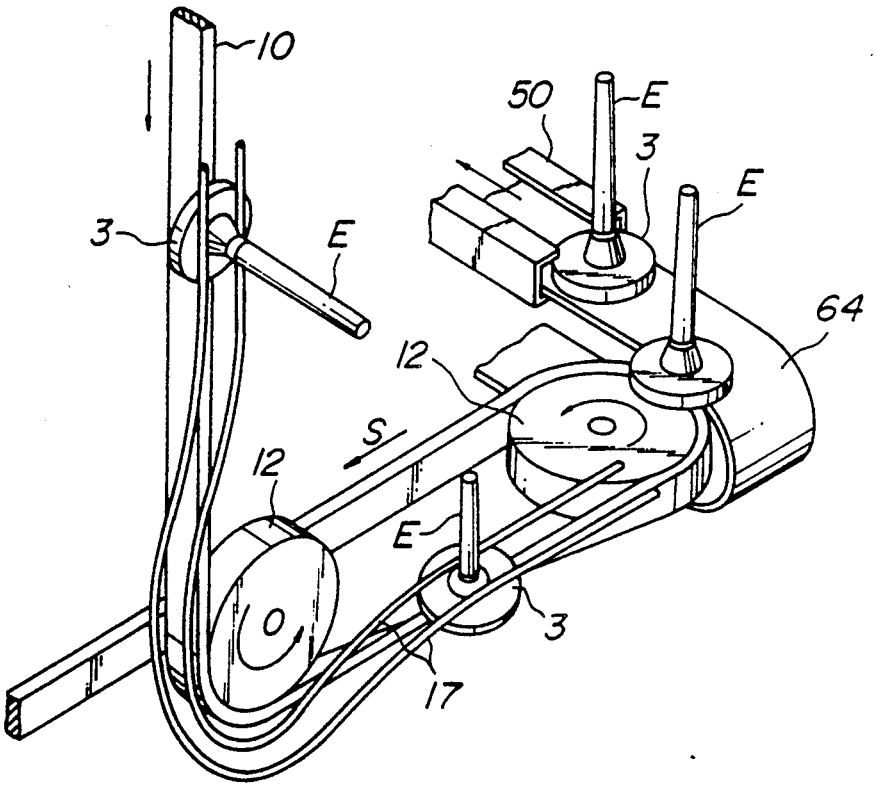
FIG. 16 is a partial perspective view of the rightside lower portion of the movable bobbin transfer device shown in FIG. 1.
Figure 20:
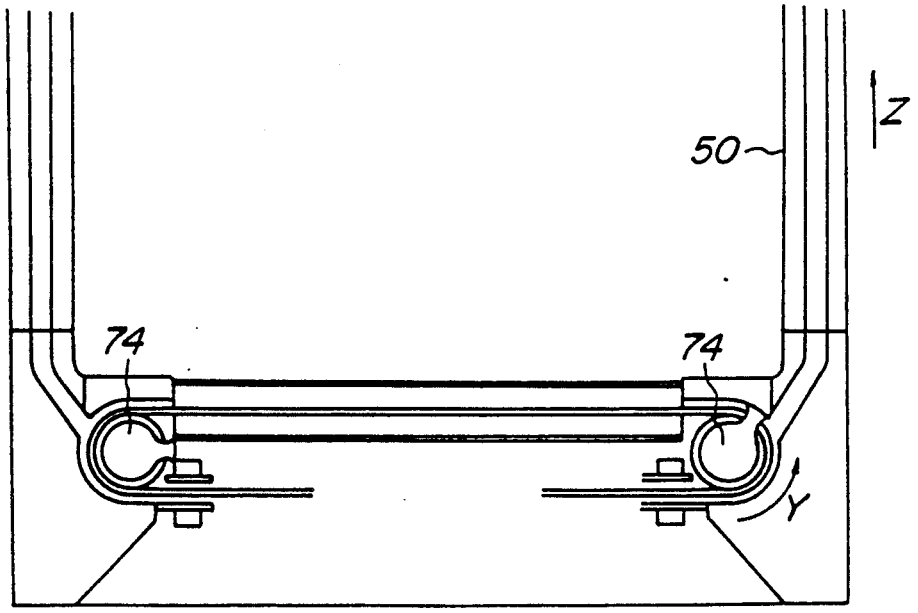
Figure 21:
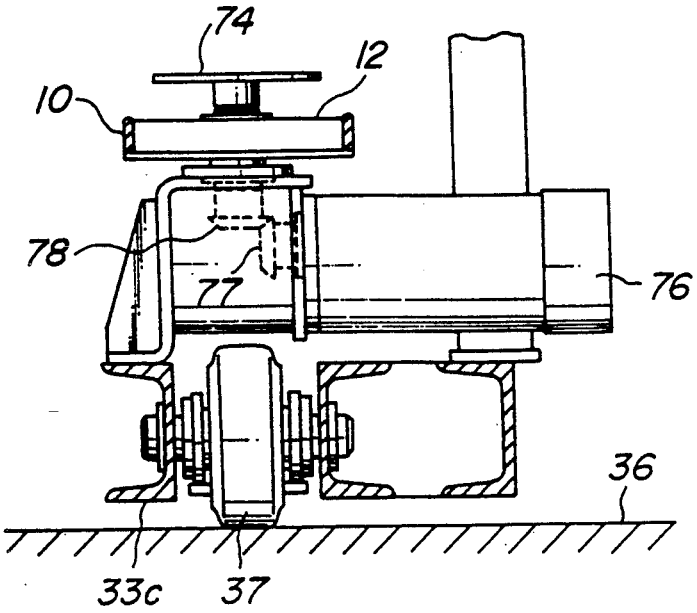
FIG. 21 is a partial elevational view illustrating the drive means for the switching guide.

FIGS. 10 and 16 illustrate portions for exchanging bobbins between the bobbin transfer bridge 50 and both right and left end regions at the lower portion of the movable bobbin transfer device 9, respectively, and FIG. 21 illustrates a control unit for a switching guide 74 provided concentrically with the guide pulley 12 arranged at both end regions. Furthermore, FIGS. 17 to 20 illustrate a passageway for guiding the peg trays 3 at the bobbin exchanging portion, and each control position of the switching guide 74.

More particularly, as shown in FIGS. 17 to 20, there are formed guide passages 50*b* for transferring the peg trays 3 on the bobbin transfer bridges 50 on both right and left sides. Guide passages 75*a* connected to the guide passages 50*b*, and guide passages 75*b* connected to the passages 75*a* are formed on a cover 75 at the bobbin exchanging portions, to extend along semicircular path around the respective guide pulleys 12 at both right and left end regions.

As shown in FIG. 21, the above-mentioned right and left pulleys 12 are each supported on a vertical shaft 12*a* which is provided with a switching guide 74 thereon. The switching guide 74 has a protrusion 74*a* extending locally in the circumferential direction for inhibiting passage of the peg tray. Each switching guide 74 is arranged so that it can be driven in a controlled manner to a desired angular position or rotational phase, by means of a geared motor 76 with a braking device via a transmission mechanism comprising bevel gears 77, 78.

Figure 12:
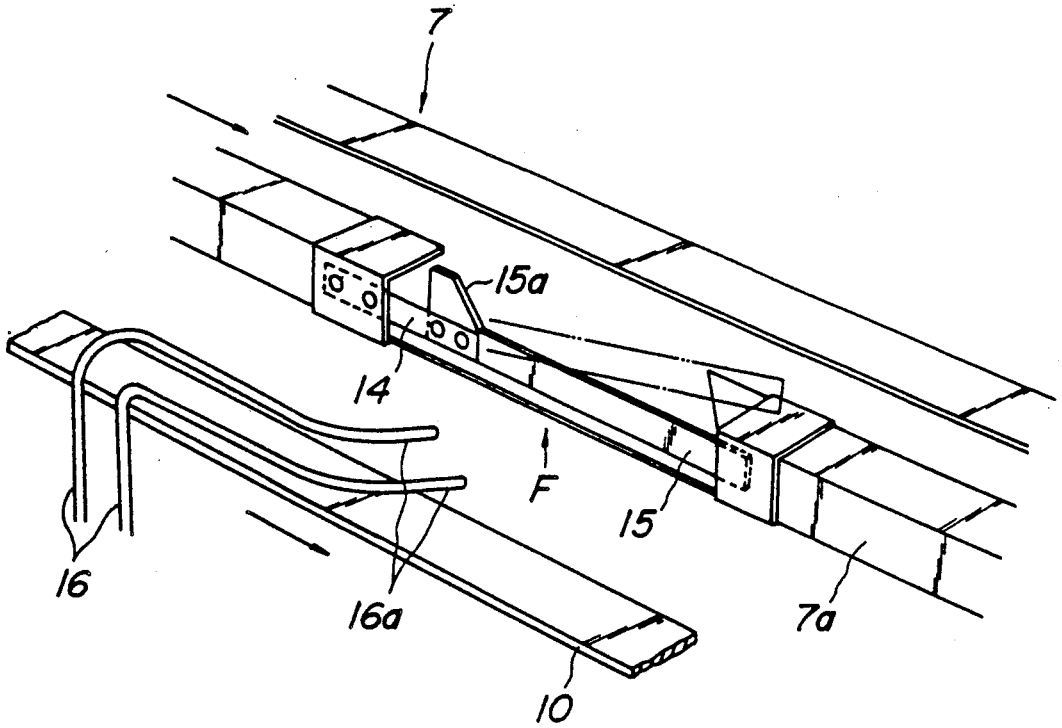
FIG. 12 is a perspective view illustrating the connection between the full bobbin conveyer and the movable bobbin transfer device.
Figure 13A:
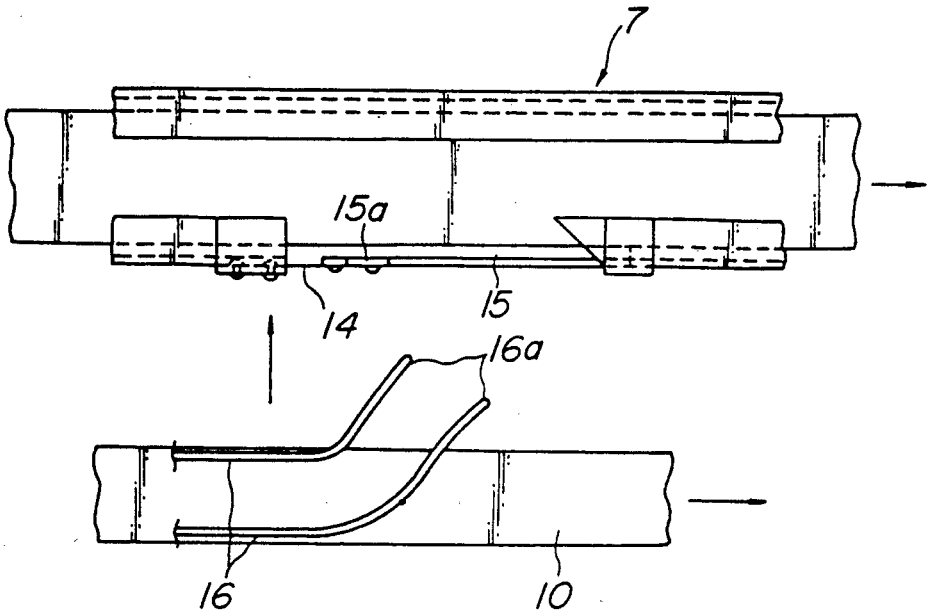
FIG. 13*a* is a plan view thereof.
Figure 13B:
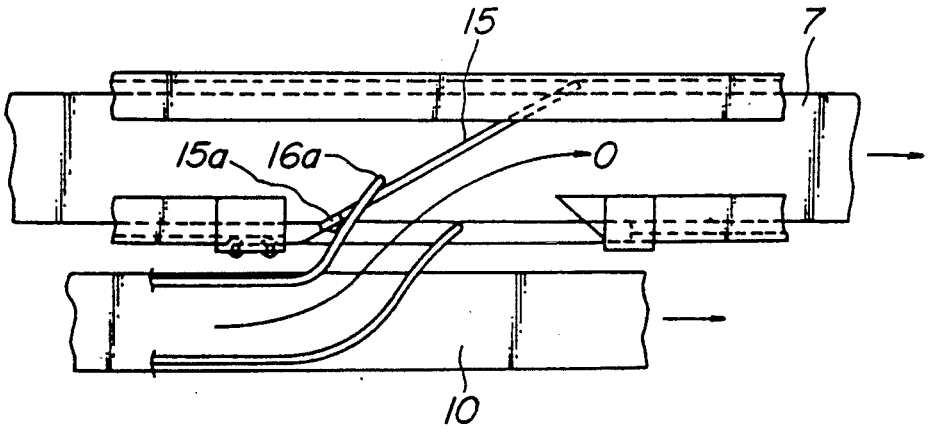
FIG. 13*b* is a plan view illustrating a state in which an empty bobbin conveyer is coupled with the movable bobbin transfer device.
Figure 14:
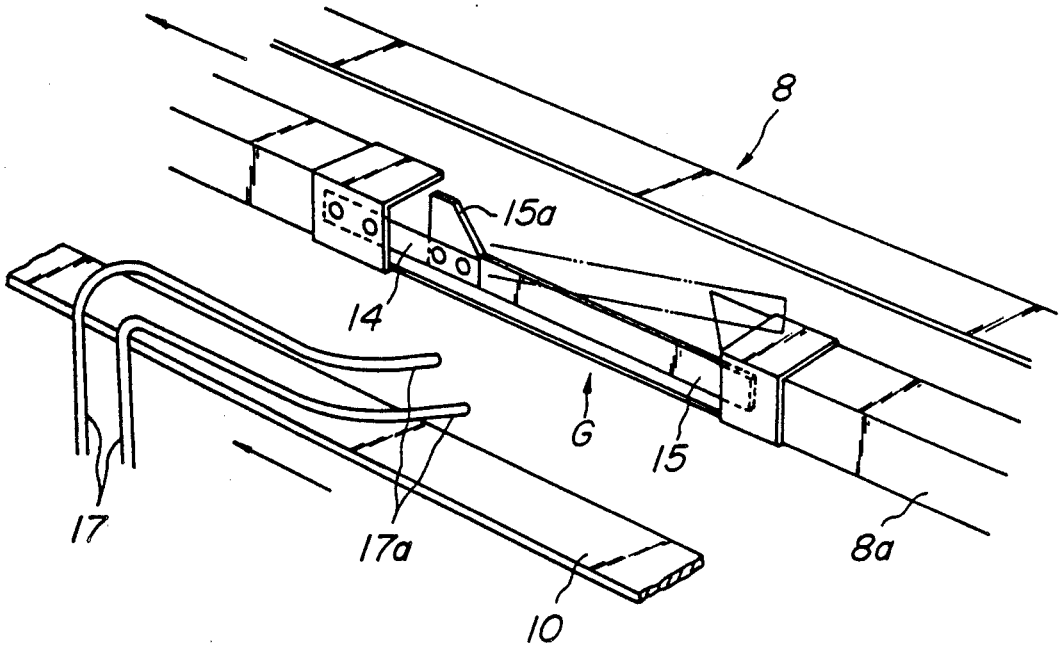
FIG. 14 is a perspective view illustrating a connection between the empty bobbin conveyer and the movable bobbin transfer device.
Figure 15A:
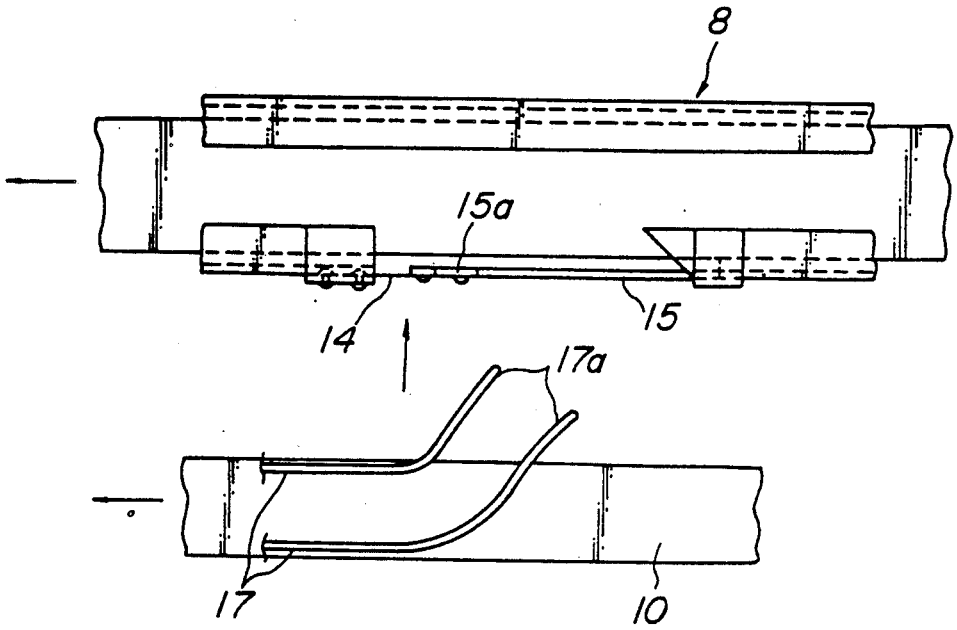
FIG. 15*a* is a plan view thereof.
Figure 15B:
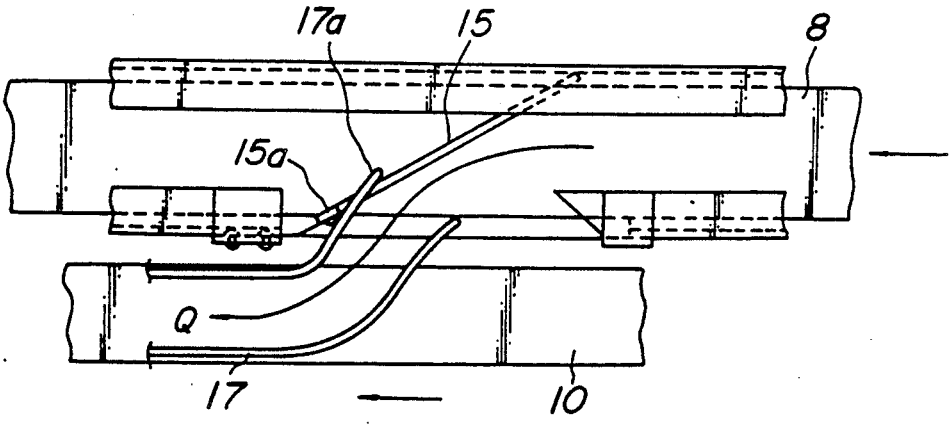
FIG. 15*b* is a perspective view illustrating the connection between the empty bobbin conveyer and the movable bobbin transfer device.

As shown in FIGS. 12, 13*a* and 13*b*, the full bobbin transfer conveyer 7 includes a guide rail 7*a* whose side edge is formed with a cutout at a location where the belt 10 runs in parallel with the conveyor 7, to provide a portion F for introducing the full bobbins. Similarly, as shown in FIGS. 14, 15*a* and 15*b*, the empty bobbin transfer conveyer 8 includes a guide rail 8*a* whose side edge is formed with a cutout at a location where the belt 10 runs in parallel with the conveyer 7, to provide an empty bobbin delivery portion G.

Each guide rail 7*a*, 8*a* is provided, at the inside of the side edge of the cutout forming the full bobbin introducing portion F or the empty bobbin delivery portion G, with a plate-shaped swing guide 15 for preventing drop of the peg trays. The swing guide 15 can be opened or closed by means of a leaf spring 14. Each linear guide members 16, 17 of the movable bobbin transfer device 9 has end portions 16*a*, 17*a* opposed to the swing guide 15, which is curved toward the conveyers 7, 8. The arrangement is such that, as the movable bobbin transfer device 9 approaches the conveyers 7, 8, the end portion 16*a*, 17*a* of each linear guide member 16, 17 comes into contact with, and pushes and opens the swing guide plate 15 to receive or deliver the bobbins. In this connection, the swing guide 15 is provided on its upper edge with a protrusion 15*a* which is intended for engaging the curved end portions 16*a*, 17*a* of the guide members 16, 17.

FIG. 22 illustrates state in which the stationary bobbin transfer device 2*b* on one side of the machine 1 is connected with the bobbin transfer bridge 50, and a passage 50*b* of the bobbin transfer bridge 50 for guiding the bobbins is obliquely deflected at its free end portion toward the stationary bobbin transfer devices 2*a*, 2*b*. The free end portion of the passage 50*b* is provided with guide pieces 50*c*, 50*d* on both sides thereof.

Further details of the apparatus according to the above-mentioned embodiment will be explained below in conjunction with the operation. When the spinning machine 1 is stopped with the tube filled, and the empty bobbins E previously prepared on the peg trays 3 on the stationary bobbin transfer devices 2*a*, 2*b* are exchanged with the full bobbins F on the spindles by means of a tube exchange device (not shown), it becomes possible to deliver the full bobbins F from the spinning machine and introduce the empty bobbins E to the spinning machine.

With this state, the apparatus according to the present invention is moved to a predetermined position along the traveling rail 32. During this travel, the support 43 integrally coupled t the movable bobbin transfer device 9 is tilted in a state remote from the conveyers 7, 8, as indicated by imaginary line in FIG. 4, with the shaft 44 of the lower end portion as its fulcrum. This tilting is performed by the action of the link element 48 as a result of rotation of the output shaft of the motor 46, and is guided by the double-link guide device 49 without being accompanied by rattlings.

Furthermore, on both sides of the lower portion of the movable bobbin transfer device 9, each bobbin transfer bridge 50 assumes an orientation in which the free end portion of the bridge has been rotated upwardly, as shown by imaginary lines in FIGS. 3 and 4.

That is, in this case, by actuating the motor 58 in one direction to drive the chain 56 in advance, the bridge support member 54 has been rotated upwardly about the axis of the horizontal shaft 53, while the bobbin transfer bridge 50 has also been rotated upwardly so as not to disturb the movement of the movable bobbin transfer device 9 along the traveling rail 32.

The movable bobbin transfer device 9 is caused to travel along the traveling rail 32 by driving the traveling rollers 41 by means of the motor 40, and is stopped at a predetermined position as shown in FIG. 1. Then, the motor 58 is actuated to drive the chain 56 in reverse direction, so that the free end portion of the bobbin transfer bridge 50 is rotated as indicated by arrow H in FIG. 1, together with the bridge support member 54. In this case, since the free end portion of the bridge 50 is slightly deviated to the outside by the action of the linear motor 67, the corresponding pulleys 51 and 52 are slightly separated from each other, as shown in FIG. 8.

Subsequently, when the linear motor 67 is driven and its actuator 67*a* actuated outwardly, i.e. in the direction indicated by arrow I in FIG. 6, the pulley 51 on the free end portion of the bridge 50 is moved by the counteraction in the direction indicated by arrow J in FIG. 8, and the pin 51*a* fits into the center hole 52*a*, as shown in FIG. 7.

In this case during the centering of the pin 51*a* with reference to the center hole 52*a*, the bridge 50 can be aligned in the longitudinal direction by engaging the roller 69 with the guide rail 68, as shown in FIGS. 4 and 5, while alignment in the vertical direction is achieved by engagement of the guide plate 72 with the horizontal reference plate 73, as shown in FIGS. 6 and 9.

On the other hand, by actuating the motor 46, the link element 48 is driven to move the movable bobbin transfer device 9 as well as the support 43 into an erected position as shown by solid lines in FIG. 4.

The motor 13 is then actuated so that the driving pulley 11 drives the belt 10 in the direction indicated by arrow in FIG. 1, while the full bobbin transfer conveyer 7 and the empty bobbin transfer conveyer 8 are driven in directions indicated by respective arrows.

Besides, the apparatus according to the illustrated embodiment is capable of performing a variety of desired operations by actuating the switching guide 74, as shown in FIGS. 17 to 20, of which one example will be explained below.

Figure 17:
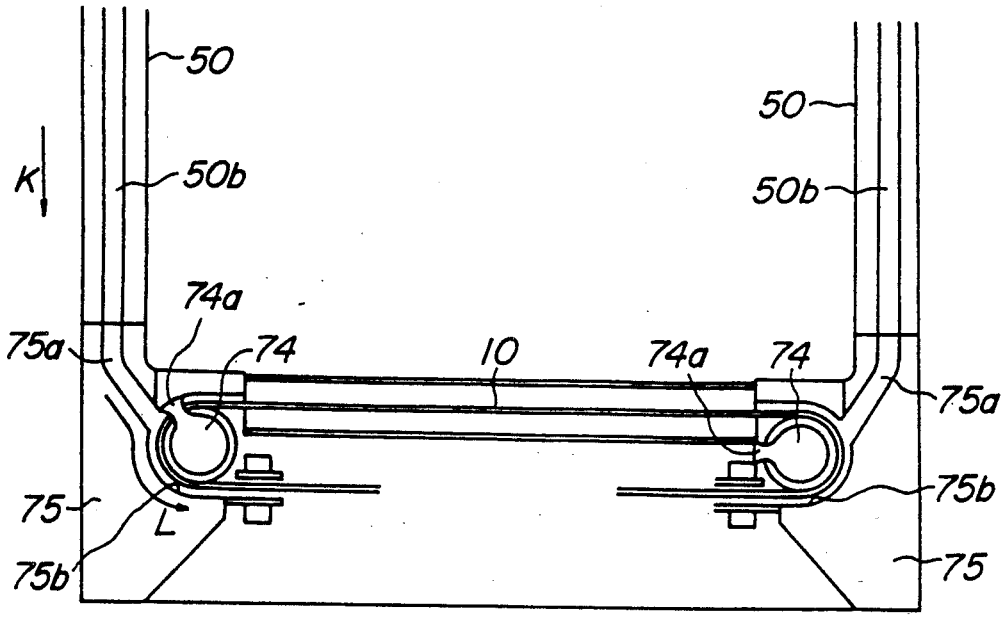
FIGS. 17 to 20 are respectively plan views illustrating various operational positions of the passages for guiding the bobbin, and of the switching guides on both sides, which are arranged between the bobbin transfer bridges and the lower end portion of the movable bobbin transfer device.

First of all, FIG. 17 illustrates one operating position of the switching guide 74 wherein the full bobbins F on the stationary bobbin transfer device 2a on one side are to be withdrawn. The motor 63 is then actuated to drive the belt 64 of the bobbin transfer bridge 50 on the side of the stationary bobbin transfer device 2a, in the direction indicated by arrow K in FIG. 1. By this, as shown in FIG. 7, the rotation of the pulley 51 is transmitted to the pulley 52 to drive the belt conveyer 5 of the stationary bobbin transfer device 2a in the same direction as that of the belt 64.

As a result, the full bobbins F on the stationary bobbin transfer device 2a are transferred onto the bobbin transfer bridge 50 (FIG. 22), and moved along the bridge 50 as indicated by arrow K in FIGS. 1 and 17, and then as indicated by arrow L in FIGS. 10 and 17. The full bobbins F are moved on intermediate rising portion as indicated by arrow M in FIGS. 1 and 10, and then moved along the horizontal portion of the belt 10 in the direction indicated by arrow N in FIG. 1. In this case, since the curved end portion 16a of the linear guide member 16 has pushed and opened the swing guide 15, as shown in FIG. 13b, the full bobbins F carried by the belt 10 are moved away as indicated by arrow 0 toward the next process station.

Figure 18:
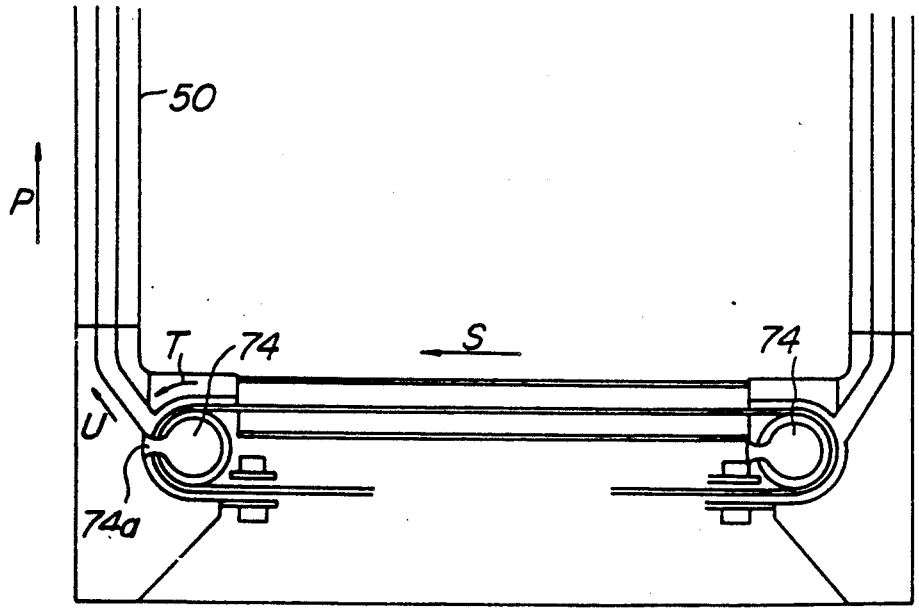

FIG. 18 illustrates another operating position of the switching guide 74 wherein the empty bobbins E are fed to the empty stationary bobbin transfer device 2a, which has already delivered the full bobbins F as described above. In this case, the motor 63 is actuated in reverse direction to set the direction in which the bobbins are fed by the bridge 50 and the belt of the stationary bobbin transfer device 2a, in the direction indicated by arrow P in FIG. 18. In this case, as shown in FIG. 15b, since the curved end portion 17a of the linear guide member 17 has pushed and opened the swing guide 15, the empty bobbins E on the empty bobbin transfer conveyer 8 are moved onto the belt 10, as indicated by arrow Q.

The empty bobbins E are transferred as indicated by arrow R in FIG. 1, along the vertical section and subsequently onto the horizontal section of the bottom portion, as shown in FIG. 16. The empty bobbins E are turned inversely by 180°, and are transferred through passages S, T and U as shown in FIGS. 16 and 18, onto the stationary bobbin transfer device 2a through the bridge 50, as indicated by arrow P.

Figure 19:
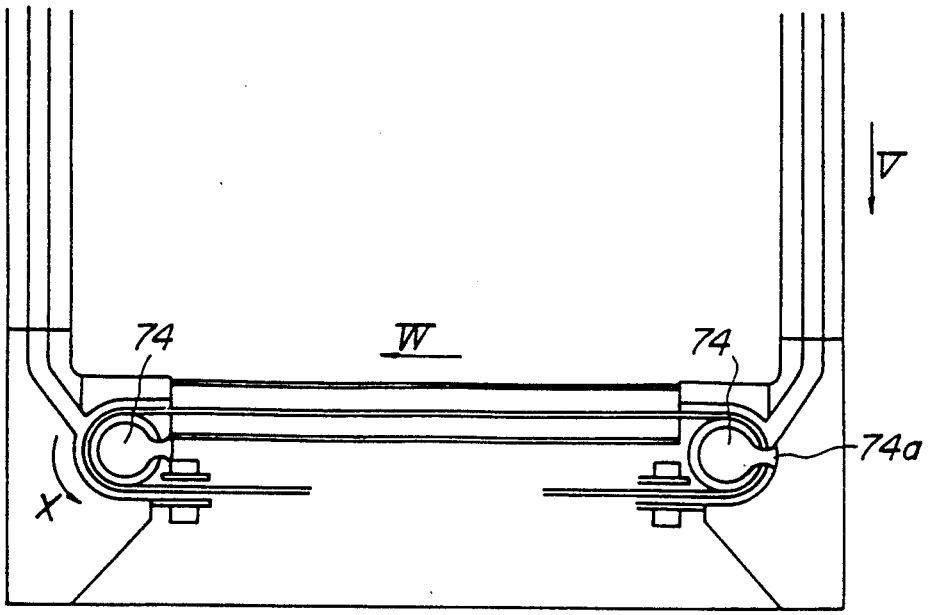

FIG. 19 illustrates another operating position of the switching guide 74 wherein the full bobbins F on the stationary bobbin transfer device 2b on the opposite side are delivered. In this case, the motor 63 is actuated to drive the belt 64 of the bridge 50 on the side of the stationary bobbin transfer device 2b, so that the belt 64 is moved in the direction indicated by arrow V in FIG. 19. By this, the full bobbins F on the stationary bobbin transfer device 2b are moved as indicated by arrows V, W and X in FIG. 19, and further moved as indicated by arrows M and N in FIG. 1 to be transferred onto the conveyer 7 as indicated by arrow 0 in FIG. 13b.

FIG. 20 illustrates another operating position of the switching guide 74 wherein the empty bobbins E are supplied to the stationary bobbin transfer device which has already been emptied, as described above and shown in the right-half of FIG. 1. In this case, as shown in FIG. 15b, the empty bobbins E are moved onto the belt 10 from the conveyer 8 as indicated by arrow Q, and are then moved in the direction indicated by arrow R in FIG. 1 and arrows Y and Z in FIG. 20, before they are supplied to the stationary bobbin transfer device 2b.

While the above explanation referred only to the operation of the stationary bobbin transfer device on one side, the operation may for example be such that the full bobbins F on the stationary bobbin transfer device 2b are delivered first of all, and the empty bobbins E are then supplied to the emptied device 2b as shown in FIG. 1, while at the same time the full bobbins on the other device 2a are withdrawn so as to be fed into the conveyer 7.

When the bobbin delivering and feeding operations are completed as described above, the actuator 67a of the linear motor 67 is actuated as indicated by arrow i in FIGS. 5 and 6, to slightly rotate the free end portion of the bridge 50 outwardly to withdraw the pin 51a shown in FIG. 7 from the center hole 52a and disengage the bridge 50 from the stationary bobbin transfer devices 2a, 2b. Subsequently, by actuating the motor 58 shown in FIGS. 3 and 4, the chain 56 is driven to upwardly rotate the free end portion of the bobbin transfer bridge 50 together with the bridge support member 54, about the axis of the horizontal shaft 3.

At the same time, the motor 46 is driven to tilt the movable bobbin delivery device 9 as well as the support 43 from the position indicated by solid lines in FIG. 4 to the external tilted position indicated by imaginary lines, by the action of the link element 48. Then, the motor 49 is actuated in accordance with an electric command signal to drive the movable bobbin transfer device 9 into a new position corresponding to another desired spinning machine 1.

While the present invention has been explained in detail with reference to specific embodiments, it is of course that various modifications may be made without departing from the scope of the invention.

What is claimed is:

1. An apparatus for transferring empty and full bobbins to and from a plurality of spinning machines, said spinning machines being arranged in side-by-side relationship with their respective longitudinal directions in parallel with each other, said bobbins being transferred by using a plurality of peg trays each having an upper surface with a peg projecting therefrom, comprising:

stationary bobbin transfer devices for transferring bobbins, arranged on opposite sides of and in a longitudinal direction of each spinning machine;

a full bobbin transfer conveyor leading to a subsequent stationary nd an empty bobbin transfer conveyor, both being supported by a ceiling so as to intersect at a substantial angle the longitudinal direction of the spinning machines, above portions of the stationary bobbin transfer devices of each spinning machine; and a movable bobbin transfer device including an endless belt wound about and extending between a driving pulley and a plurality of guide pulleys, and linear guide members disposed along and cooperating with said belt for resiliently engaging with each peg tray by pinching the peg thereof, said movable bobbin transfer device being arranged so as to be movable along said conveyors supported by the ceiling to receive empty bobbins from said empty bobbin transfer conveyor and deliver full bobbins to said full bobbin transfer conveyors, said movable bobbin transfer device having a lower end portion which is pivotally connected on opposite sides thereof with respective one ends of bobbin transfer bridges, said bobbin transfer bridges being rotatable such that free end portions of said bridges can be respectively coupled to said stationary bobbin transfer devices of selected ones of said spinning machines.

2. The apparatus as set forth in claim 1, wherein a traveling rail is provided parallel to said bobbin transfer conveyors on the ceiling, and arranged such that said movable bobbin transfer device can be moved along said traveling rail.

3. The apparatus as set forth in claim 2, wherein said movable bobbin transfer device includes a frame which is movable along said traveling rail and suspended to extend downwardly close to a floor surface, a support having upper and lower end portions, said lower end portion being pivotally supported by said frame, said upper portion being movable toward and away from said bobbin transfer conveyors on the ceiling.

4. The apparatus as set forth in claim 1, wherein said stationary bobbin transfer devices on both sides of the spinning machine each includes an endless belt with one end portion to be opposed to the free end portion of a corresponding bobbin transfer bridge and associated with a pulley, the free end portions of the bobbin transfer bridges being each rotatable in horizontal and vertical planes and provided with a pulley which can be detachably fitted with the pulley of the stationary bobbin transfer device such that the endless belt of the stationary bobbin transfer device can be driven by the pulley of the bridge.

5. The apparatus as set forth in claim 1, wherein each bobbin transfer conveyor on the ceiling is guided by a guide rail having a side edge which is formed with a cutout at a bobbin receiving and delivering portion between the bobbin transfer conveyor and said movable bobbin transfer device, said side edge being provided with a swing guide adjacent to said cutout for preventing drop of a tray, which can be maintained in its closed position by means of a spring, the linear guide members of the movable bobbin transfer device each having an end portion opposed to said swing guide and curved toward the bobbin transfer conveyor, such that when said movable bobbin transfer device approaches the conveyor, the end portion of said linear guide member pushes the swing guide to open it against said spring for allowing the bobbins to be received and delivered across said cutout.

6. The apparatus as set forth in claim 1, wherein said movable bobbin transfer device includes a lower end portion having outer side regions each provided with a first pulley supported on a vertical shaft for passing a peg tray transfer belt therethrough, a second pulley supported on a horizontal shaft on an outer side of the first pulley, and arranged at a junction where the bridge is pivotally supported, a third pulley arranged at the free end of the bridge so that another peg tray transfer belt is passed through the second and third pulleys, the peg tray transfer belts cooperating with each other to form a passage extending along a semicircular path around the first pulley for guiding the peg trays from the bridge, the first pulleys each being coaxially provided with a switching guide having a protrusion on its outer periphery, the switching guide being angularly movable between a first operational position for allowing passage of the peg trays, and a second operational position in which the protrusion inhibits the passage of the peg trays.

* * * * *